US006911994B2

(12) United States Patent
Sumi et al.

(10) Patent No.: US 6,911,994 B2
(45) Date of Patent: Jun. 28, 2005

(54) THERMAL DEVELOPMENT APPARATUS, THERMAL DEVELOPMENT METHOD AND THERMAL DEVELOPMENT PHOTOSENSITIVE MATERIAL USED IN THERMAL DEVELOPMENT APPARATUS

(75) Inventors: Makoto Sumi, Hachioji (JP); Hajime Ishimoto, Hachioji (JP)

(73) Assignee: Konica Corporation, Tokyo (JP)

( * ) Notice: Subject to any disclaimer, the term of this patent is extended or adjusted under 35 U.S.C. 154(b) by 57 days.

(21) Appl. No.: 10/614,801

(22) Filed: Jul. 9, 2003

(65) Prior Publication Data

US 2004/0080605 A1 Apr. 29, 2004

(30) Foreign Application Priority Data

Jul. 17, 2002 (JP) ..... 2002-208438
Dec. 25, 2002 (JP) ..... 2002-373841
Dec. 25, 2002 (JP) ..... 2002-373843

(51) Int. Cl.[7] ..... G03D 13/00
(52) U.S. Cl. ..... 347/228
(58) Field of Search ..... 347/140, 156, 347/212, 228; 219/216, 243, 24; 430/330, 336, 350, 353

(56) References Cited

U.S. PATENT DOCUMENTS

RE33,770 E * 12/1991 Torino et al. ..... 399/331
5,750,260 A 5/1998 Ryther
6,007,971 A * 12/1999 Star et al. ..... 430/350
6,262,756 B1 7/2001 Kashino et al.

FOREIGN PATENT DOCUMENTS

EP 0 760 969 11/1995

* cited by examiner

*Primary Examiner*—Huan Tran
(74) *Attorney, Agent, or Firm*—Finnegan Henderson Farabow Garrett & Dunner, L.L.P.

(57) ABSTRACT

A thermal development apparatus capable of preventing thermal development failure because of improvement on a characteristic required of a resilient member. The thermal development apparatus has: a heating section for heating thermal development photosensitive material within which a latent image is established, and maintaining temperature of the thermal development photosensitive material at thermal development temperature; and a conveyance section for conveying the thermal development photosensitive material with the heating section, wherein the heating section has a cylindrical sleeve, a heat source provided inside of the cylindrical sleeve, and a resilient member on an external surface of the cylindrical sleeve, and the resilient member has a smooth layer as an outermost layer thereof.

56 Claims, 25 Drawing Sheets

THERMAL DEVELOPMENT APPARATUS, THERMAL DEVELOPMENT METHOD AND THERMAL DEVELOPMENT PHOTOSENSITIVE MATERIAL USED IN THERMAL DEVELOPMENT APPARATUS

BACKGROUND OF THE INVENTION

1. Field of the Invention

The invention relates to a thermal development apparatus and a thermal development method for heating and developing thermal development photosensitive material, and thermal development photosensitive material used in the thermal development apparatus.

2. Description of Related Art

The thermal development apparatus comprises: for example, a temperature-controlled heating unit such as a heating drum or the like; a thermal development unit comprising a biasing component such as a roller or the like placed as opposed to the heating unit; and a cooling conveyance unit for cooling down thermal development photosensitive material heated by the heating unit. The thermal development apparatus is an apparatus that performs a thermal development process by heating and conveying the thermal development photosensitive material, while the biasing component biases the thermal development photosensitive material which is exposure-processed against a surface of the heating unit and makes the material contact the surface.

In the thermal development apparatus, in order to evenly and uniformly heat the thermal development photosensitive material, a resilient member with thermostability such as silicon rubber or the like, is placed on the surface of the heating unit for obtaining more evenness and uniformity of the thermal development photosensitive material between the heating unit and the biasing component.

For example, as disclosed in Tokuhyo-Hei 10-500497 (U.S. Pat. No. 6,007,971), in a thermal development process for heating and developing the thermal development photosensitive film (hereinafter, it is also called "film"), as a method for heating the film, the heating drum having a surface coated with the resilient member (silicon rubber) with a characteristic of thermostability and high conductivity is in practical use.

However, because of a gaseous component such as organic acid or the like emitted from the thermal development photosensitive material when the thermal development photosensitive material is heated, deterioration of the silicon rubber is accelerated. If the silicon rubber is deteriorated and altered, desired density cannot be obtained because it is impossible to heat the thermal development photosensitive material appropriately. Further, as well as the deterioration of the silicon rubber due to the above-described gas effect, the silicon rubber continuously expands and contracts and gradually grows up its shape (fattening its diameter) because of heating and cooling, and finally defection such as a crack appears on its surface. As a result, the defection causes heating unevenness, which appears on the thermal development photosensitive material as development density unevenness and non-uniformity.

Further, when the gaseous component emitted from the thermal development material, is condensed and adheres to the resilient member which has high adhesiveness such as silicon rubber or the like, it is difficult to clear away the condensed and adhering gaseous component stain despite cleaning. Furthermore, the stained part causes heating unevenness which appears on the thermal development photosensitive material as development density unevenness.

Furthermore, a diameter of the heating unit gradually differs depending on whether or not it is a path of the film due to the gas effect. If only one type of film width is processed, it will not be troublesome, but if more than two types of film width are processed, there will be unevenness caused from the smaller width film within an image range of the largest width film. Therefore, it is not possible to evenly and uniformly keep the film contacted with the surface of the heating member. As a result, it is not possible to obtain density evenness and uniformity.

As mentioned above, although there are a plurality of characteristics required of the resilient member (silicon rubber) to prevent thermal development failure at the thermal development apparatus, the resilient member in an earlier art cannot satisfy all the characteristics at once.

SUMMARY OF THE INVENTION

A first object of the present invention is to provide a thermal development apparatus, a thermal development method and thermal development photosensitive material appropriate for the thermal development apparatus capable of preventing thermal development failure, by improving the characteristic required of the resilient member.

A second object of the present invention is to provide a thermal development apparatus and a thermal development method capable of conveying thermal development photosensitive material stably with amount of electro static charge reduced, when the heating drum conveying and heating the thermal development material for development, has a smooth layer made of fluorine resin or the like on an outer surface of the resilient member.

A third object of the present invention is to provide a thermal development apparatus and a thermal development method capable of surely rotating a rotation component with following a rotation of the heating drum for controlling a position of a guide member relative to the heating drum, preventing smooth layer from being damaged and preventing the heating drum from deteriorating when the heating drum conveying and heating the thermal development material for development, has the smooth layer such as fluorine resin or the like on its surface.

In accordance with a first aspect of the present invention, a thermal development apparatus comprises; a heating unit for heating thermal development photosensitive material within which a latent image is established, and maintaining the thermal development photosensitive material at thermal development temperature; and a conveyance unit for conveying the thermal development photosensitive material with the heating unit. Further, the heating unit comprises; a cylindrical sleeve; a heat source provided inside of the cylindrical sleeve; and a resilient member on an external surface of the cylindrical sleeve. Further, the resilient member comprises a smooth layer on its outermost surface.

Preferably, the above-mentioned apparatus further comprises a biasing component for biasing the thermal development photosensitive material against the heating unit.

According to the apparatus of the first aspect of the present invention, the resilient member placed on the external surface of the heating unit of the thermal development apparatus includes the smooth layer on its outermost layer with a characteristic corresponding to a predetermined purpose. Here, the characteristic corresponding to a predetermined purpose means, especially, a characteristic required for either stable thermal development in the thermal development apparatus or prevention of thermal development failure. For example, the above-mentioned characteristic includes, stability against deterioration or alteration on the resilient member, durability for improving intensity of the resilient member, resilience for adjusting a resilient force on the resilient member, and so on. As mentioned above, the resilient member can have a plurality of characteristics which are a combination of a characteristic of the smooth layer on its outermost surface of the resilient member and a characteristic of an internal layer of the resilient member. Consequently, in the thermal development apparatus, the resilient member which has a plurality of characteristics required for stable thermal development can be formed. As a result, it is possible to provide the thermal development apparatus capable of preventing thermal development failure.

Preferably, thickness of the smooth layer is equal to or more than 30 $\mu$m, more preferably 30 $\mu$m to 50 $\mu$m.

With the above-mentioned smooth layer, it is possible to assure heat supply to the thermal development photosensitive material for stable thermal development. Consequently, it is possible to perform stable thermal development at the thermal development apparatus.

Preferably, the mentioned smooth layer has predetermined resistance to chemical reaction.

Since the smooth layer, that is the surface of the mentioned resilient member, has predetermined resistance to chemical reaction, it is possible to prevent chemical reaction or alteration of the resilient member from composite attack of chemicals and heat. Accordingly, a property of the resilient member can be stabilized for preventing thermal development failure.

Preferably, the mentioned layer is made of a compound including fluorine.

Since the smooth layer of the mentioned resilient member is made of a compound including fluorine, the resilient member can obtain a characteristic of resistance to chemical reaction as well as its surface intensified. As a result, alteration and deterioration on the resilient member can be prevented, as well as adhesion of dust or dirt, especially stain condensed from gaseous component emitted from the thermal development photosensitive material can be prevented. Consequently, it is possible to prevent thermal development failure.

Preferably, the apparatus further comprises a temperature detecting unit for detecting surface temperature of the smooth layer by being in contact with the smooth layer.

According to the apparatus, the resilient member has high intensity as well as a low friction coefficient due to the compound including fluorine structuring the smooth layer of the resilient member. As a result, when the temperature detecting unit is in direct contact with the smooth layer of the resilient member, neither is the smooth layer of the resilient member damaged nor friction load causes malfunction or damage of the temperature detecting unit. Therefore, since it is possible to detect the surface temperature of the heating unit by bringing the temperature detecting unit in direct contact with the resilient member, more accurate temperature of the heating unit can be detected. Consequently, it is possible to perform stable thermal development.

Preferably, the apparatus of the first aspect of the present invention further comprises a cleaning unit for cleaning the smooth layer.

Since the cleaning unit for cleaning the smooth layer of the resilient member placed at the heating unit is placed at the thermal development apparatus, it is possible to clear away adhering dust or dirt, especially stain condensed from the gaseous component emitted from the thermal development photosensitive material on the surface of the resilient member. Therefore, it is possible to prevent an effect on the surface temperature of the heating unit due to the adhering stain such as dust, dirt or the like, on the surface of the resilient member of the heating unit, and to prevent non-uniform contact of the thermal development material on the surface of the heating unit. Consequently, it is possible to perform appropriate thermal development without thermal development failure. Further, since the adhering stain or the like on the surface of the resilient member can easily be cleared away by the cleaning unit, maintenance labor on the thermal development apparatus can be omitted. As a result, it is possible to reduce a cost of maintenance and repair on the thermal development apparatus.

In accordance with a second aspect of the present invention, thermal development photosensitive material adoptable for the thermal development apparatus comprises a particle for providing predetermined frictional resistance in a contact surface thereof with the smooth layer.

Since the contact surface which is in contact with the smooth layer of the resilient member, of the thermal development photosensitive material used for the thermal development apparatus includes the particle for providing the predetermined frictional resistance on its surface, contact between the thermal development photosensitive material and the resilient member can be adjusted based on the predetermined frictional resistance. As a result, it is possible to perform stable thermal development.

Preferably, in the photosensitive material, a particle diameter of the particle is 0.5 $\mu$m to 10 $\mu$m.

Since the particle diameter of the particle included in the thermal development photosensitive material is 0.5 $\mu$m to 10 $\mu$m, frictional resistance between the thermal development photosensitive material and the resilient member can appropriately be adjusted. Consequently, it is possible to perform stable thermal development on the thermal development photosensitive material.

Preferably, the photosensitive material further comprises the same substance as one of which the smooth layer is made.

Since the thermal development photosensitive material comprises the same substance as one of which the smooth layer of the resilient member is made, it is possible to reduce electro static charge between the thermal development photosensitive material and the resilient member. Consequently, the thermal development photosensitive material is not drawn to the resilient member due to accumulated electro static charge and keeps constant transport path. As a result, it is possible to perform stable thermal development.

In accordance with a third aspect of the present invention, the apparatus of the first aspect of the present invention further comprises a driving unit for driving the heating unit to rotate; and a control unit for controlling the heating unit so as to rotate the heating unit at lower speed when the thermal development photosensitive material is not conveyed than when the thermal development photosensitive material is conveyed.

Preferably, the apparatus further comprises: a plurality of opposed rollers placed so as to be opposed to the heating unit; and a biasing member for biasing the plurality of opposed rollers against the heating unit. Further, the conveyance unit conveys the thermal development photosensitive material nipped between the heating unit and the opposed roller by the biasing member by driving the heating unit to rotate by the driving unit.

According to the present apparatus, if the heating unit on which the smooth layer made of almost electrically insulated material such as fluorine resin or the like is placed rotates in contact with the plurality of opposed rollers, electrification caused by separation between the thermal development photosensitive material and the smooth layer happens as many times as the number of the opposed rollers. Therefore, the faster the heating unit rotates, the more amount of electro static charge is accumulated. However, since the heating unit is rotated at lower speed when the thermal development photosensitive material is not conveyed for such a stand-by period as there is no print requirement to the apparatus, it is possible to reduce the amount of electro static charge. As a result, it is possible to stably convey the thermal development photosensitive material with reducing the amount of electro static charge.

Preferably, each of the plurality of opposed rollers is made of metal and grounded.

Accordingly, electro static charge can be discharged to the ground through the opposed roller. As a result, it is possible to reduce the amount of electro static charge on the heating unit and the opposed roller.

Here, in order to reduce the amount of electro static charge of the heating unit, the apparatus may also comprise an electro static charge removal member, for example, an electro static charge brush, for discharging the electro static charge on the heating unit.

Preferably, a first gear is provided at at least one end of the heating unit, and a second gear which engages with the first gear is provided at at least one end of at least one opposed roller of the plurality of opposed rollers. The at least one opposed roller is driven to rotate by the first gear and the second gear.

Accordingly, compared with the case that the opposed roller is rotated with following the rotation of the heating unit which has a low friction coefficient, the rotation of the opposed roller is assured. Consequently, it is possible to reduce frictional electrification caused by temporary or regular stop of the opposed rollers. Further, it is possible to prevent damage (a scratch or the like) on the smooth layer and the film.

Preferably, the smooth layer is made of fluorine resin.

Accordingly, the deterioration from the gas emitted from the thermal development photosensitive material at thermal development on the resilient member made of silicon rubber or the like, can be prevented.

Preferably, the control unit controls the heating unit to rotate the heating unit at lower speed for a warm-up period of the apparatus than when the thermal development photosensitive material is conveyed.

According to the present apparatus, if the heating unit on which the smooth layer made of almost electrically insulated material such as fluorine resin or the like is placed, rotates in contact with the plurality of opposed rollers, the electrification caused by separation on the thermal development photosensitive material happens as many times as the number of the opposed rollers. However, since the heating unit rotates at low speed for the warm-up period of the apparatus such as when it is turned on, it is possible to reduce the amount of the electro static charge. As a result, it is possible to stably convey the thermal development photosensitive material with reducing the amount of the electro static charge.

In accordance with a fourth aspect of the present invention, a thermal development method comprises: heating and conveying thermal development photosensitive material between a heating unit which comprises the smooth layer, the heating unit is driven to rotate, and a plurality of opposed rollers biased against the heating unit; and driving the heating unit to rotate at lower speed when the thermal development photosensitive material is not conveyed than when the thermal development photosensitive material is conveyed.

In the method of the fourth aspect of the present invention, when the heating unit having the smooth layer made of almost electrically insulated material such as fluorine resin or the like rotates in contact with the plurality of opposed rollers, electrification caused by separation between the thermal development photosensitive material and the opposed rollers happens as many times as the number of the opposed rollers. Therefore, the faster the heating unit rotates, the more time electrification caused by separation happens and the more amount of electro static charge is accumulated. However, since the heating unit rotates at low speed, when the thermal development photosensitive material is not conveyed, such as the case that there is no print requirement to the apparatus for a predetermined period, or for the warm-up period after its power is turned on, it is possible to reduce the amount of the electro static charge. As a result, it is possible to stably convey the thermal development photosensitive material with reducing the amount of electro static charge.

Preferably, in the above-mentioned method, the smooth layer is made of fluorine resin.

As a result, it is possible to prevent gas emitted from the thermal development photosensitive material upon development from deteriorating the resilient member such as silicon rubber under the smooth layer.

In accordance with a fifth aspect of the present invention, the apparatus of the first aspect of the present invention further comprises: a cooling conveyance unit for cooling and conveying the thermal development photosensitive material, and a guide component for guiding the thermal development photosensitive material from the heating unit to the cooling conveyance unit. Further, the guide component comprises a pair of rotation components, capable of rotating with following a rotation of the heating unit, as opposed to both ends of a rotation axis of the heating unit for maintaining its relative position to the heating unit. Further, each of the rotation components comprises a component with a high friction coefficient against the smooth layer of the heating unit.

Preferably, each of the rotation components comprises a resilient component as the component with the high friction coefficient.

According to the present apparatus, the resilient component placed at the rotation component has a higher friction coefficient than one made of general metal to the smooth layer made of fluorine resin or the like. And the resilient component is in contact with the smooth layer of the heating unit. As a result, since the rotation component can surely be rotated with following the rotation of the heating unit, the rotation component do not have to be biased against the heating unit more than necessary. Consequently, it is possible to prevent damage on the smooth layer, such as a scratch, peeling or the like, and stain on the heating unit.

Preferably, the smooth layer is made of fluorine resin.

Accordingly, the deterioration on the resilient member of the heating unit by the gas emitted from the thermal development photosensitive material at thermal development can be prevented.

Preferably, the resilient component includes a rubber layer provided at a periphery of each of the rotation components.

Preferably, the resilient component includes a ring-shaped component provided at the periphery of the rotation component.

Preferably, a groove in which the resilient component is fitted is formed at the periphery of each of the rotation components. For example, when the resilient component has a cylindrical shape, the groove is formed on the periphery of the rotation component so that the cylindrically shaped component is fitted into the groove. And when the resilient component has a ring-like shape such as an O-ring or the like, competitively a narrow groove is formed at the periphery of the rotation component.

Preferably, the resilient component of each of the rotation components is made of the same substance as the resilient member of the heating unit.

In accordance with a sixth aspect of the present invention, a thermal development apparatus comprises: a heating unit for heating and conveying a photothermographic element within which a latent image is established, and maintaining the photothermographic element at thermal development temperature; and a cooling unit for cooling and conveying the heated photothermographic element wherein, the heating unit comprises a heating member, a resilient member outside of the heating member, and a smooth layer at uppermost surface of the resilient member.

Preferably, thickness of the smooth layer is equal to or more than 30 $\mu$m, more preferably 30 $\mu$m to 50 $\mu$m.

Preferably, the smooth layer has predetermined resistance to chemical reaction.

Preferably, the smooth layer is made of a component including fluorine.

Preferably, thermal development photosensitive material adoptable for the apparatus of the sixth aspect of the present invention comprises a particle for providing predetermined frictional resistance in a contact surface thereof with the smooth layer.

Preferably, a particle diameter of the particle is 0.5 $\mu$m to 10 $\mu$m.

Preferably, the photosensitive material of the sixth aspect of the present invention further comprises the same substance as one of which the smooth layer is made.

Preferably, the apparatus of the sixth aspect of the present invention conveys various size of the photothermographic element, which is formed in a square shape and which is any width in a perpendicular direction to a conveying direction of the heating section.

BRIEF DESCRIPTION OF THE DRAWINGS

The present invention will become more fully understood from the detailed description given hereinafter and the accompanying drawing given by way of illustration only, and thus are not intended as a definition of the limits of the present invention, and wherein.

EMBODIMENTS OF THE INVENTION

Hereinafter, embodiments of the present invention will be explained with reference to figures.

[First Embodiment]

Figure 1:
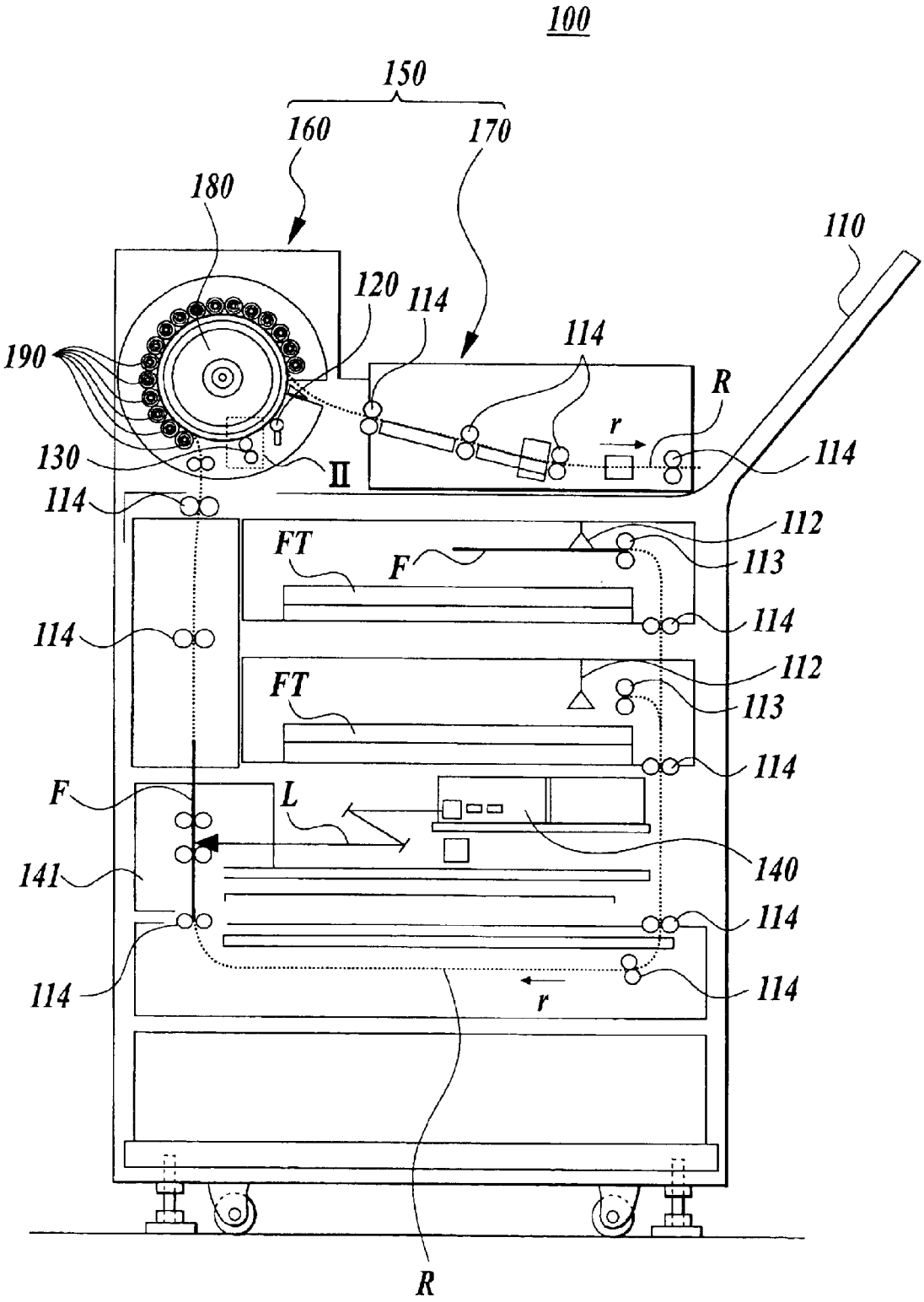
FIG. 1 is a front sectional view schematically showing a thermal development apparatus 100 according to a first embodiment of the present invention.

FIG. 1 is a front sectional view schematically showing of the thermal development apparatus in the present invention.

As shown in FIG. 1, the thermal development apparatus 100 comprises a thermal development process unit 150 comprising a thermal development unit 160 and a cooling conveyance unit 170 or the like placed on its top. Further, the thermal development apparatus 100 also comprises an exposure unit 140 placed below the thermal development process unit 150 within the apparatus.

In the thermal development apparatus 100, a thermal development photosensitive film F which is sheet-shaped thermal development photosensitive material, contained in a containing tray FT is drawn by a film pick-up unit 112 and conveyed to a feeding roller pair 113. Furthermore, the thermal development photosensitive film F conveyed to a feeding roller pair 114 is conveyed in direction r following a conveyance path R by the feeding roller pair 114 for being processed according to various processes.

The exposure unit 140 irradiates a laser beam L to the thermal development photosensitive film F for exposure at an exposure position 141. As a result, a latent image is established within the film F.

The thermal development unit 160 is used for heating and developing the thermal development photosensitive film F within which the latent image is established at predetermined temperature. For example, the thermal development unit 160 comprises a heating unit 180, a film biasing member 190 such as a roller and so on.

The heating unit 180, for example, comprises: a heating drum D (refer to FIG. 2) formed in a hollow shape and made of aluminum; a resilient member 181 (refer to FIG. 2) on a surface of the heating drum D for the thermal development photosensitive film F contacted with the heating unit 180; and so on. Further, the heating drum D comprises a heat source (not shown in FIG) such as a halogen lamp heater, a rubber heater or the like therein. Further, the heating unit 180 also comprises a temperature sensor 120 through a smooth layer as a temperature detecting member in contact with the resilient member 181 for detecting temperature of the heating unit 180, in order to control temperature of the heating unit 180. Further, the heating unit also comprises a cleaning unit 130 as a cleaning member for cleaning the surface of the heating unit 180. Further, the temperature sensor may be placed inside of the heating drum D even in the case that a smooth layer is placed on the surface of the resilient member 181 of the heating drum D.

The film biasing unit 190 is, for example, a film biasing roller as a film biasing component. The film biasing unit 190 biases the thermal development photosensitive film F against the surface of the heating unit 180 while the film F is heated, to perform the thermal development process.

The cooling conveyance unit 170 simultaneously conveys and cools down the thermal developed thermal development photosensitive film F and ejects the film F to an ejection tray 110.

Figure 2:
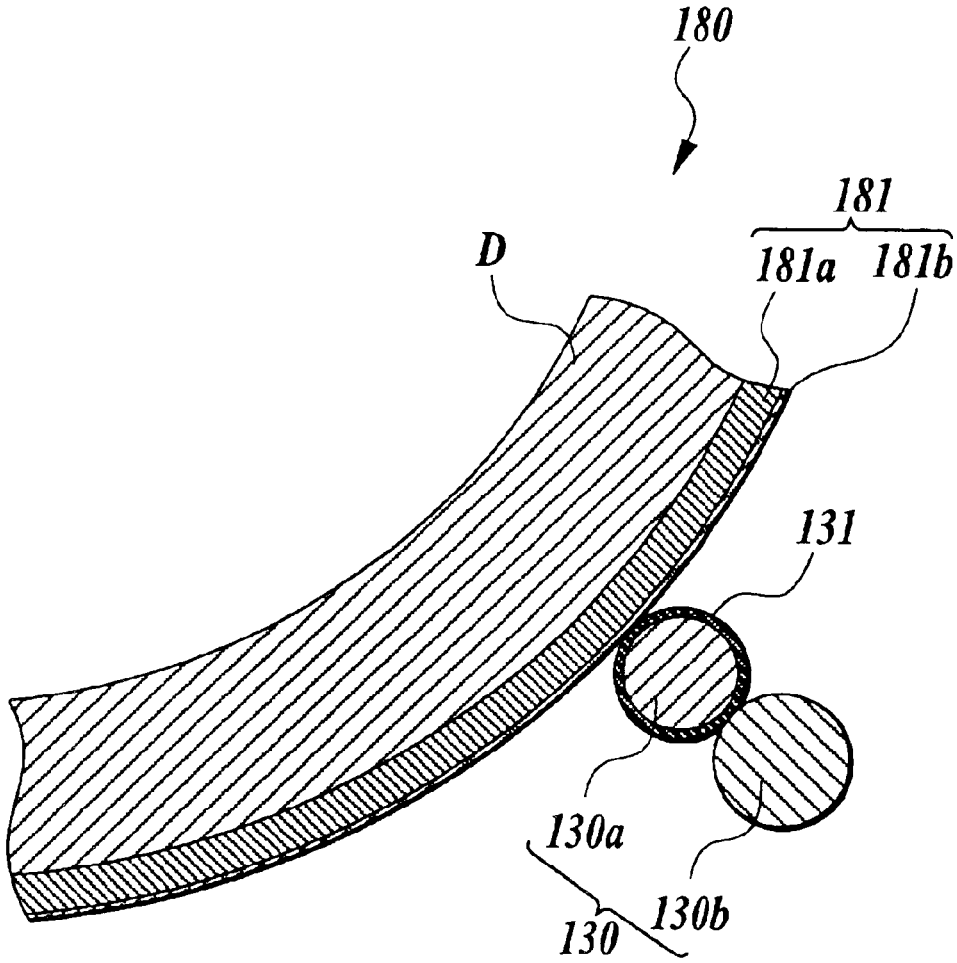
FIG. 2 is an enlarged sectional view showing part II shown in FIG. 1 of a heating unit 180.

Secondly, the resilient member 181 placed on the surface of the heating unit 180 will be explained. FIG. 2 is an enlarged view showing part II shown in FIG. 1.

As shown in FIG. 2, the resilient member 181, for example, comprises: a rubber layer 181*a* formed with silicon rubber coating on the surface of the heating drum D of the heating unit 180; and a fluorine coated layer 181*b* as a surface layer covered with fluorine resin on the surface of the rubber layer 181*a*.

As the fluorine resin, for example, a chemical compound, such as Polytetrafluoroethylene (PTFE), Polychlorotrifluoroethylene (PCTFE), Polyvinylidene Fluoride (PVDF), copolymer of Tetrafluoroethelen and Perfluoroalkoxyiethylene (PFA), copolymer of Ethylene and Tetrafluoroethylene (ETFE), Tetrafluoroethylene and Hexafluoropropylene (FEP) or the like is used.

When the thermal development photosensitive film F for thermal development is conveyed to the mentioned thermal development unit 160, the film F is biased by the film biasing unit 190 against the heating unit 180 and conveyed between the heating unit 180 and the film biasing unit 190 as the heating unit 180 is drive to rotate and the film biasing unit 190 is rotated with following the rotation of the heating unit 180. Since the heating unit 180 has the resilient member 181 on its surface, the thermal development photosensitive film F entirely contacts to the heating unit 180, therefore the film F can be heated evenly and uniformly with ease.

Although the thermal development photosensitive film F emits gas including, for example, organic acid, higher fatty acid and so on, when the film F is heated for thermal development, the fluorine resin is not reacted with the gaseous component such as organic acid or the like therefore not deteriorated because the fluorine resin comprised in the fluorine coated layer 181*b* on the surface of the resilient member 181 is material with resistance to chemical reaction. Further, the fluorine resin prevents the gaseous component permeating. In other words, since the rubber layer 181*a* is coated with the fluorine coated layer 181*b*, the rubber layer 181*a* is not exposed to the gaseous component such as organic acid or the like which could cause deterioration or alteration.

Therefore, since the deterioration or alteration on the resilient member 181 is prevented for long time, the resilient member 181 can maintain initial resilience and conductivity.

Further, the fluorine coated layer 181*b* made of fluorine resin, as well as increases intensity of the surface of the heating unit 180, decreases frictional resistance of the surface of the heating unit 180. Therefore, as shown in FIG. 1, even when the temperature sensor 120 is in direct contact with the resilient member 181, damage on the surface of the resilient member 181 (the fluorine coated layer 181*b*) is practically prevented. Further, malfunction, deterioration or damage of the temperature sensor 120 because of the friction load is practically prevented as well. Therefore, it is possible to detect surface temperature of the heating unit 180 by bringing the temperature sensor 120 in direct contact with the resilient member 181. As a result, it is possible to considerably simplify a transmitting section, such as a slip ring or the like, for obtaining a signal from a sensor placed inside of the drum which is a heating movable body, and detect the temperature.

Further, as shown in FIGS. 1 and 2, the cleaning unit 130 for cleaning the surface of the fluorine coated layer 181*b* of the resilient member 181, is placed in contact with the heating unit 180 (the resilient unit 181).

The cleaning unit 130 comprises: an adhesive roller 130*a* comprising an adhesive sheet 131 on its surface in contact with the surface of the heating unit 180 (the resilient member 181); and a cleaning roller 130*b* in contact with the adhesive roller 130*a* for additionally cleaning up adhering stain on a surface (the adhesive sheet 131) of the adhesive roller 130*a*. First, the stain or the like which adheres to the surface of the heating unit 180 (the resilient member 181) adheres to and is cleaned by the adhesive sheet 131 of the adhesive roller 130*a* with adhesiveness of the adhesive sheet 131. Since the surface of the adhesive roller 130*a* with the adhering stain is cleaned by the cleaning roller 130*b*, the surface of the heating unit 180 can always be cleaned by a non-stained adhesive surface of the adhesive roller 130*a*. Further, since the surface of the adhesive roller 130*a* is cleaned by the cleaning roller 130*b*, adhesiveness of the adhesive roller 130*a* lasts sufficiently. As a result, cleaning effect lasts sufficiently.

Here, since the fluorine coated layer 181*b* is placed on the surface of the heating unit 180, adhesion of stain, dust or the like, condensed from gaseous component emitted from the thermal development photosensitive material is prevented, as well as it is easy to clear away the adhering stain by the cleaning unit 130. Therefore, it is possible to prevent heating unevenness which could be caused by adhering stain at the heating unit 180.

Further, as mentioned above, since the cleaning unit 130 can easily clean the stain or the like, maintenance labor on the thermal development apparatus 100 can be omitted. As a result, it is possible to reduce a cost of maintenance and repair on the thermal development apparatus 100.

Further, a method for preparing the fluorine coated layer 181*b* may not be limited to the above-described method for coating the surface of the rubber layer 181 with fluorine resin, but may also be a method for covering the heating unit 180 with a tube component made of fluorine resin or fluorine rubber.

However, since conductivity of fluorine resin or fluorine rubber is not as high as that of silicon rubber, it is necessary at the resilient member 181 to adjust conductivity of the resilient member 181 as desired, by adjusting thickness balance between the rubber layer 181*a* made of silicon rubber and the fluorine coated layer 181*b* made of fluorine resin or fluorine rubber.

Figure 3:
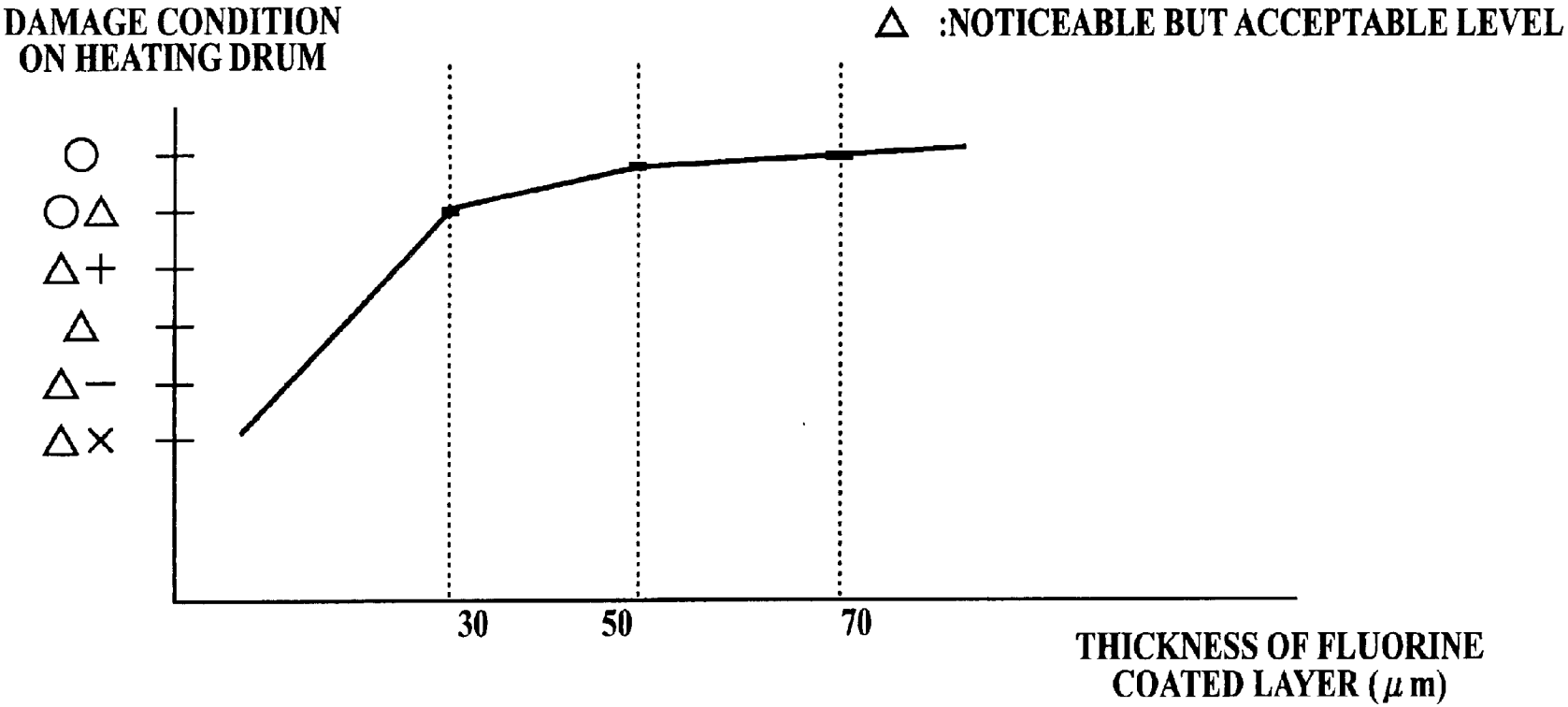
FIG. 3 is a graph showing relationship between thickness and a damage condition on a fluorine coated layer 181*b* of the surface of the heating unit 180.

Further, in terms of durability of the heating drum D, preferably, the thicker fluorine coated layer 181*b* is better. As shown in FIG. 3, considering an effect (density unevenness) on image quality due to (thermal transmission) unevenness caused by a surface damage condition (shape stability including thickness and presence of defection) of the fluorine coated layer 181*b* along with a film processing, thickness of the fluorine coated layer 181*b* is preferably equal to or more than 30 $\mu$m.

Figure 4:
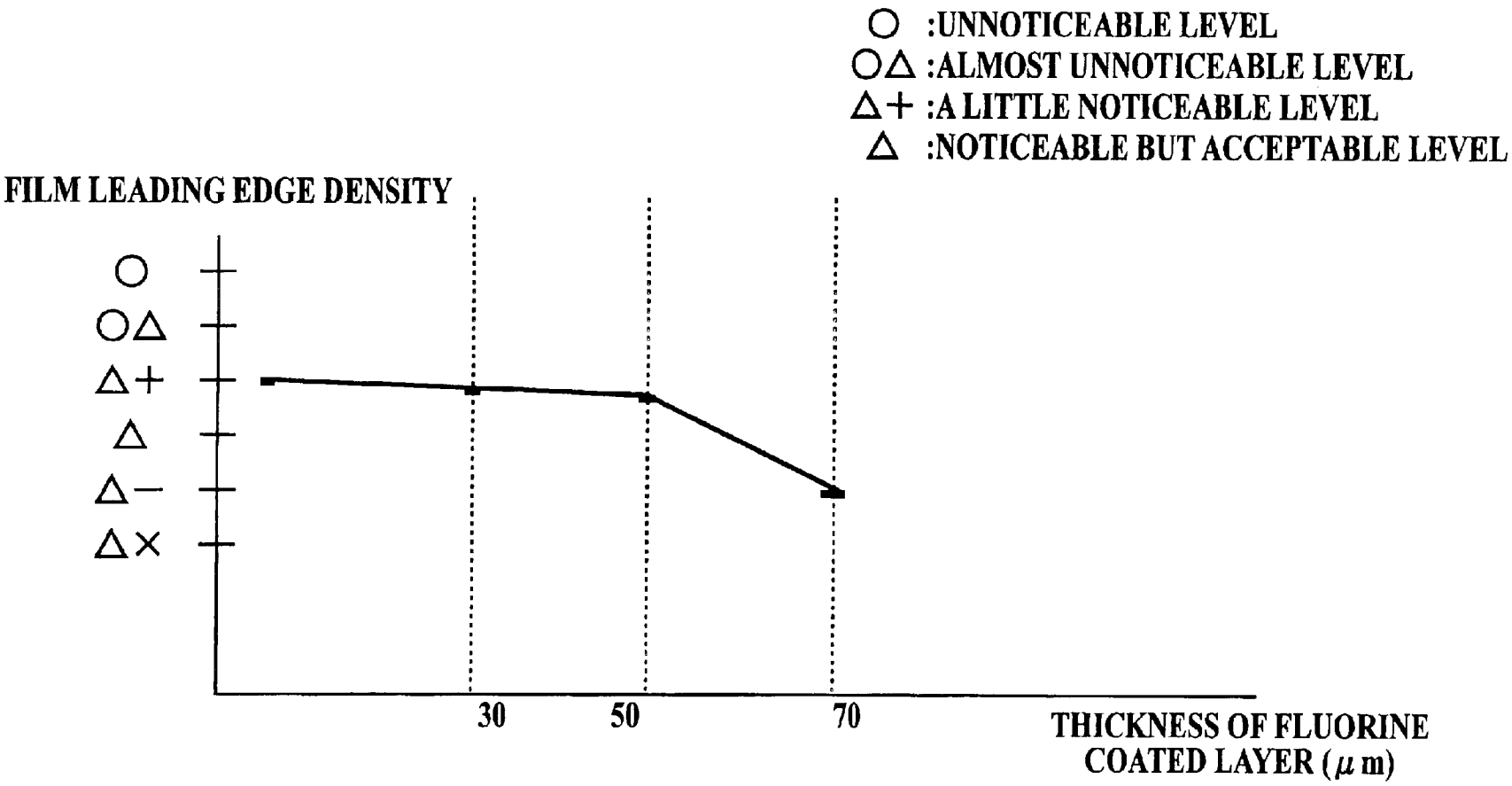
FIG. 4 is a graph showing relationship between the thickness of the fluorine coated layer 181*b* of the heating unit 180 and leading edge density of a thermal development photosensitive film F.

On the other hand, with the system of the opposed roller, a leading edge part of the thermal development photosensitive film F is difficult to contact the heating drum D while being heated and conveyed. As a result, it may cause density unevenness. As shown in FIG. 4, when the thickness of the fluorine coated layer 181*b* excesses 50 $\mu$m, the phenomenon that density of the leading edge decreases becomes noticeable.

As mentioned above, considering the mechanical characteristic of the surface of the heating drum D and the image quality (density unevenness), the thickness of the fluorine coated layer 181*b* is preferably 30 $\mu$m to 50 $\mu$m.

Thirdly, the thermal development photosensitive film F used in the thermal development apparatus 100 of the present invention will be explained.

Figure 5:
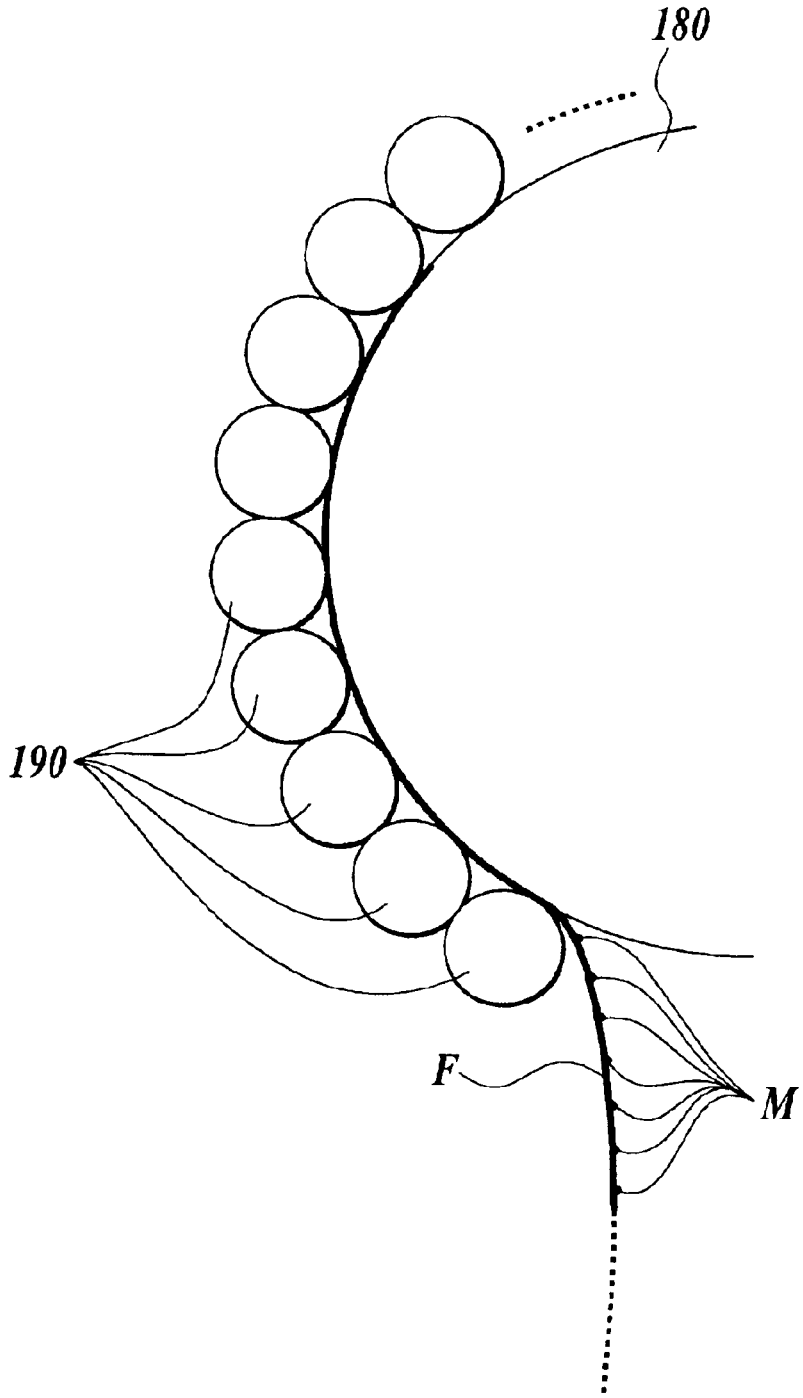
FIG. 5 is a view for describing a state of the thermal development photosensitive film F conveyed to the heating unit 180.

The fluorine coated layer 181*b* is coated on the surface of the heating unit 180 of the thermal development apparatus 100. Because of smoothness of the fluorine coated layer 181*b*, the thermal development photosensitive film F could slip when being conveyed with being nipped between the heating unit 180 and the film biasing unit 190. As a result, it may not be possible to convey the thermal development photosensitive film F appropriately. Therefore, as shown in FIG. 5, when the thermal development photosensitive film F is conveyed between the heating unit 180 and the film biasing unit 190, matte substance M is put on a side of the thermal development photosensitive film F in contact with the heating unit 180, for forming a convex part thereon.

The matte substance M used in the present invention may be either inorganic or organic matter. For example, as the inorganic matter, silica disclosed in Swiss Patent No. 330, 158, glass power disclosed in French Patent No. 1,296,995, carbonate such as alkaline earth metal, cadmium, zinc or the like disclosed in GB patent No. 1,173,181, or the like may be used as the matte substance M. As the organic matter, organic matte substance such as, starch disclosed in U.S. Pat. No. 2,322,037, starch derivatives disclosed in Belgian Patent No. 625,451 and GB patent No. 981,198, Polyvinylalcohol disclosed in Tokuko-Sho No. 44-3643, Polystyrene or Polymethacrylate disclosed in Swiss Patent No. 330,158, Polyacrylonitrile disclosed in U.S. Pat. No. 3,079,257, Polycarbonate disclosed in U.S. Pat. No. 3,022,169, or the like may be used.

The matte substance M may be in either a definite form or an infinite form, but preferably it is in the definite form, and more preferably in a spherical form.

A size of the matte substance M is expressed by a diameter of a sphere having volume equal to the matte substance M, is used. In the present invention, a particle diameter of the matte substance M means the diameter of the sphere. An average particle diameter of the matte substance M used in the present invention is preferably 0.5 $\mu$m to 10 $\mu$m, more preferably 1.0 $\mu$m to 8 $\mu$m. Further, a variation coefficient of particle size distribution is preferably equal to or less than 50%, more preferably equal to or less than 40%, particularly preferably equal to or less than 30%.

Here, the variation coefficient of particle size distribution is expressed in an equation (1) as below:

$$\text{(Standard Deviation of particle diameter)/(Average of particle diameter)} \times 100 \quad (1)$$

The matte substance M may be contained in any comprised layer of the thermal development photosensitive film F. However, in order to achieve the purpose of the present invention, the matte substance M is preferably contained in a comprised layer other than a photosensitive substance layer, more preferably be in the outermost layer.

According to the present invention, the surface of the thermal development photosensitive film F may be coated with coating liquid into which the matte substance M is contained in advance. Also, the matte substance M may be sprayed on the surface of the thermal development photosensitive film F while the surface is wet with the coating liquid. Further, if a plurality of types of matte substance M are to be added, both the methods may be used simultaneously.

The added matte substance M as mentioned above, can create larger frictional resistance on the thermal development photosensitive film F against the fluorine coated layer

181*b* of the heating unit 180. Therefore, since it is possible to adjust the frictional resistance of the film F by changing a type, an inclusion ratio, a particle size or the like of the matte substance M, it is possible to stabilize the conveyance of the thermal development photosensitive film F.

Further, when the particle diameter of the matte substance M to be included in the thermal development photosensitive film F is equal to or less than 0.5 $\mu$m, the frictional resistance on the thermal development photosensitive film F against the fluorine coated layer 181*b* has almost no difference from a case without the matte substance M. Further, when the particle diameter of the matte substance M is equal or more than 10 $\mu$m, adhesiveness between the thermal development photosensitive film F and the resilient member 181 becomes insufficient. Therefore, the particle diameter of the matte substance M is preferably 0.5 $\mu$m to 10 $\mu$m.

Further, the thermal development photosensitive film F comprises the same substance as one of the fluorine coated layer 181*b*. As mentioned above, since the thermal development photosensitive film F comprises a part including the same substance as one of the fluorine coated layer 181*b* of the heating unit 180, it is possible to prevent electro static charge due to slip between the thermal development photosensitive film F and the fluorine coated layer 181*b*. Therefore, it is possible to stabilize the conveyance of the thermal development photosensitive film F more.

As mentioned above, in the thermal development apparatus 100 of the present invention, the resilient member 181 of the heating unit 180 comprises the fluorine coated layer 181*b* made of fluorine resin which has resistance to chemical reaction, on its surface. Consequently, it is possible to prevent alteration or deterioration of the resilient member 181 from the gaseous component such as organic acid, higher fatty acid or the like emitted from the thermal development photosensitive film F when it is heated for thermal development. Therefore, it is possible to maintain initial resilience and conductivity of the resilient member because the alteration or the deterioration of the resilient member 181 is prevented for long time. Therefore, it is possible that the thermal development apparatus 100 comprising the heating unit 180 with the resilient member 181 performs stable thermal development without thermal development failure.

Further, the fluorine coated layer 181*b* intensifies the surface of the heating unit 180, as well as decreases frictional resistance of the surface of the heating unit 180. Therefore, since the temperature sensor 120 can be in direct contact with the heating unit 180, it is possible to detect the surface temperature of the heating unit 180, therefore the temperature controllability of thermal development temperature improves. As a result, it is possible that the thermal development apparatus 100 performs more stable thermal development.

Further, since the heating unit 180 is coated with the fluorine coated layer 181*b*, stain, dust or the like condensed from the gaseous component emitted from the thermal development photosensitive material is difficult to contact the heating unit 180 (the resilient member 181). Also, the adhering stain can easily be cleared away with cleaning. As a result, it is possible to prevent unevenness which could be caused from adhesion unevenness around the adhering stain on the heating unit 180. Therefore, thermal development failure is prevented.

Further, since the matte substance M made of a small particle is put on the side of the thermal development photosensitive film F in contact with the resilient member 181, it is possible to adjust the frictional resistance on the thermal development photosensitive film F against the fluorine coated layer 181*b* of the heating unit 180. Therefore, it is possible to stabilize the conveyance of the thermal development photosensitive film F.

Further, since the thermal development photosensitive film F comprises the part including the same substance as one of the fluorine coated layer 181*b* of the heating unit 180, it is possible to prevent electro static charge due to slip between the thermal development photosensitive film F and the fluorine coated layer 181*b*. Therefore, it is possible to stabilize the conveyance of the thermal development photosensitive film F.

As a result, on the thermal development photosensitive film F, it is possible to perform stable thermal development.

Figure 6:
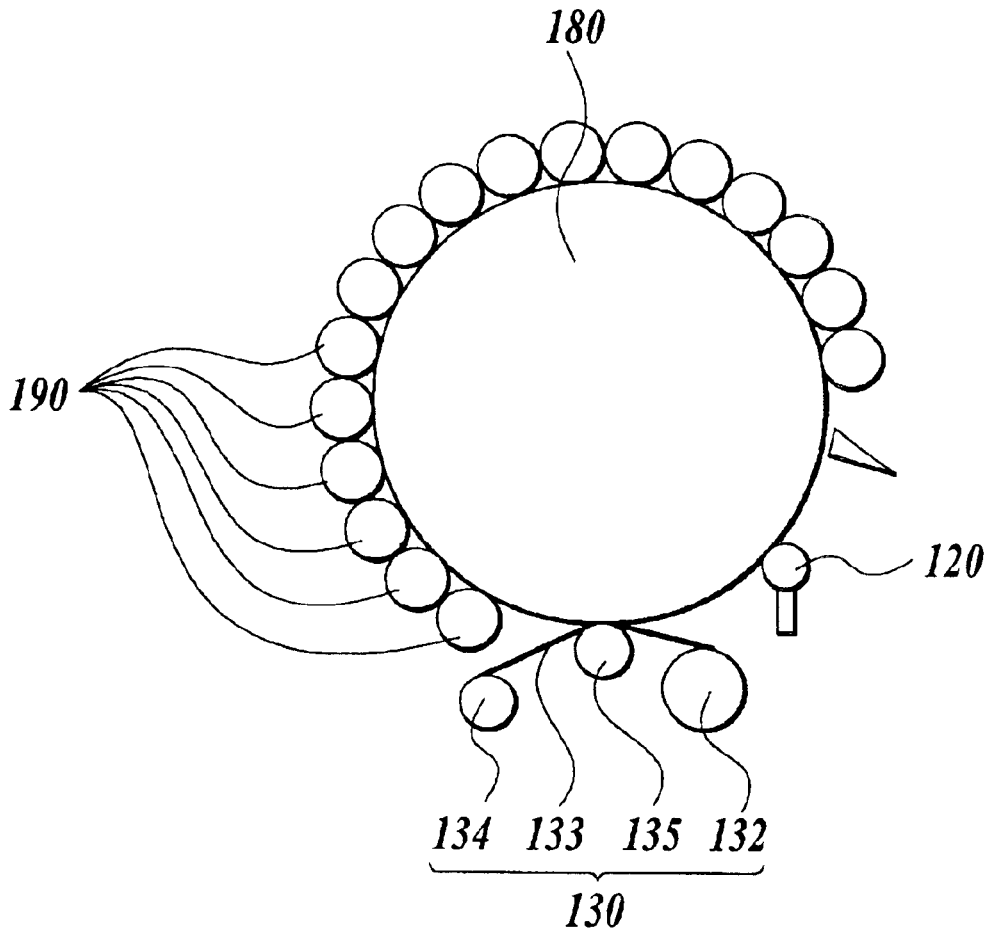
FIG. 6 is a view showing a modified example of a cleaning unit 130 of the thermal development apparatus 100 according to the first embodiment.

Further, according to the above-mentioned embodiment, the cleaning unit 130 comprising the adhesive roller 130*a*, cleaning roller 130*b* and so on, has been explained as an example of the cleaning section, but the cleaning section may not be limited to the cleaning unit 130. The cleaning unit 130 as the cleaning section may also be in another shape as long as it can clear away the stain from the surface of the heating unit 180 (the resilient member 181). For example, as shown in FIG. 6, the cleaning unit 130 may comprise: a wind-off roller 132, a cleaning sheet 133 which is wound in the wind-off roller 132, a roll-up roller 134 which reels up the cleaning sheet 133, a biasing roller 135 which biases the cleaning sheet 133 against the surface of the heating unit 180 (the resilient member 181) may be used instead. The cleaning sheet 133 may be, for example, raising fabric made of thermostable fabric such as, Polytetrafluoroethylene, Polyimide or the like. The cleaning sheet 133, while being biased against the surface of the heating unit 180 (the resilient member 181) by the biasing roller 135, wipes and clears away the stain from the surface of the heating unit 180 (the resilient member 181).

Further, the heating unit 180 may be not only in a drum-like shape as a cylindrical shape, but also a plate heater in a flat plate shape.

Further, the resilient member 181 may not only have two layers of the rubber layer 181*a* and the fluorine coated layer 181*b*, but also have more than the two layers as long as durability, conductivity, resilience and so on are considered.

Further, a characteristic corresponding to a predetermined purpose may not only be, stability for preventing deterioration and alteration of the resilient member, a characteristic for preventing the stain from adhering to the surface of the resilient member, durability for improving intensity of the resilient member, or resilience for adjusting a resilient force of the resilient member, but may also be a characteristic required to stabilize thermal development in the thermal development apparatus, or a characteristic for preventing thermal development failure. The number as well as a combination of the characteristic of the resilient member may be any.

In addition, concrete detailed structure or the like is, of course, possible to change accordingly.

According to the first embodiment of the present invention, the resilient member 181 placed on the surface of the heating unit 180 of the thermal development apparatus 100, comprises a plurality of layers including a surface layer with the characteristic for the predetermined purpose. That is, the resilient member 181 can have a plurality of characteristics which is a combination of the characteristic from the fluorine coated layer 181*b* which is the surface of the resilient member 181 and the characteristic from the rubber layer 181*a* which is the internal layer of the resilient member 181. Therefore, it is possible to form the resilient member 181 which has the plurality of characteristics required to stabilize thermal development in the thermal development apparatus 100. As a result, it is possible to provide the thermal development apparatus capable of preventing thermal development failure.

Especially, since the fluorine coated layer 181 which is the surface layer of the resilient member 181, comprises predetermined resistance to chemical reaction, it is possible to prevent the alteration and the deterioration of the resilient member 181 by chemical reaction which could be caused from chemicals, heat, and so on. Therefore, it is possible to stabilize property of the resilient member 181, and to prevent thermal development failure in the thermal development apparatus 100. Further, even when film paths of all sizes toward a heating section are different among them, since it is possible to prevent damage due to a path of the edge of the sheet film on the heating section, it is possible to have a desirable result that the effect of the film path does not appear as an image even when the film of a different size is conveyed.

Further, especially, since the fluorine coated layer 181*b* of the resilient member 181 is made of chemical compound including fluorine, the resilient member 181 obtains the characteristic of resistance to chemical reaction as well as has its surface intensive and smooth. Therefore, alteration or deterioration is prevented on the resilient member 181. Also, it is difficult to make dust or dirt, especially stain condensed from the gaseous component emitted from the thermal development photosensitive film F as the thermal development photosensitive material adhere. As a result, it is possible to prevent thermal development failure in the thermal development apparatus 100.

Further, especially, since the component including fluorine comprised in the fluorine coated layer 181*b* of the resilient member 181 gives the resilient member 181 high intensity and the low friction coefficient, even when the temperature sensor 120 which is the temperature detecting section is in direct contact with the resilient member 181, damage on the fluorine coated layer 181*b* of the resilient member 181 is prevented. Also, malfunction, deterioration or damage of the temperature sensor 120 due to the friction load is prevented. Therefore, it is possible to detect more accurate temperature of the surface of the heating unit 180 by bringing the temperature sensor 120 in direct contact with the heating unit 180. As a result, it is possible to perform more stable thermal development in the thermal development apparatus 100.

Further, especially, since the cleaning unit for cleaning the surface of the resilient member 181 placed at the heating unit 180, is placed in the thermal development apparatus 100, it is possible that the cleaning unit 130 cleans the surface of the resilient member 181 to clear away adhering dust, dirt or the like, especially the stain which is a condensed gaseous component emitted from the thermal development photosensitive film F. Therefore, it is possible to prevent an effect on the surface temperature of the heating unit 180, by the stain such as dust, dirt or the like which adheres to the surface of the resilient member of the heating unit 180, as well as it is possible to prevent non-uniform contact of the thermal development photosensitive film F on the surface of the heating unit 180. Therefore, it is possible to perform suitable thermal development without thermal development failure. Further, since the cleaning unit 130 can easily clear away the stain or the like adhering to the surface of the resilient member 181, the maintenance labor of the thermal development apparatus 100 can be omitted. As a result, it is possible to reduce the cost of maintenance and repair on the thermal development apparatus 100.

Further, since the particle providing predetermined frictional resistance to the thermal development photosensitive film F as the thermal development material used in the thermal development apparatus 100 is put on the surface of the thermal development photosensitive material in contact with the resilient member 181, it is possible to adjust the contact into predetermined frictional resistance between the thermal development photosensitive film F and the resilient member 181, for performing stable thermal development.

Further, especially, since the particle diameter of the particle contained in the thermal development photosensitive film F is 0.5 $\mu$m to 10 $\mu$m, the frictional resistance on the thermal development photosensitive film F against the resilient member 181 can be adjusted as suitable. As a result, it is possible to perform stable thermal development to the thermal development photosensitive film F.

Further, especially, when the thermal development photosensitive film F comprises the same substance as one of the fluorine coated layer 181*b* of the resilient member 181, it is possible to prevent electro static charge due to slip between the thermal development photosensitive film F and the resilient member 181. As a result, it is possible to perform stable thermal development without the thermal development photosensitive material drawn to the resilient member 181 needlessly.

On the other hand, in view of the reduction in the load of the heating drum D rotating, since it is better that the cleaning unit 130 is not always contacted with the heating drum D, the cleaning unit 130 may have a crimp release device.

In this case, for example, when the width of film passing on the heating drum D is 14 inches and three sizes of film, 14×17, 14×14 and 14×11, is processed, the surface on the heating drum D of the width (14 inches) of the maximum size is cleaned. Therefore, there is not any problem that cleaning on the heating drum D is done only at the beginning of energization of the apparatus, right before the power of the apparatus turns off, when new film is to be loaded after the film is emptied or the like. However, when the width of film passing on the heating drum D is various, for example, film having the width of 14 inches is processed after one or a plurality of sheets of film having size smaller than 14 inches such as 8×10 are processed, there are differences between the surface on which the smaller sized film passes and the surface on which it does not pass, regarding adhesion of small extraneous substance on the surface of the heating drum D. Therefore, there is a possibility of unevenness appearing on the film of 14 inches.

Therefore, when it is necessary to change from smaller sized film to larger sized film, it is possible to obtain a uniformed image (density) in width direction by applying the cleaning unit 130 on the surface of the heating drum D, for example, applying the cleaning unit 130 for one round of the heating drum D. As a result, it is possible to prevent unevenness of the film in width direction.

[Second Embodiment]

According to the above-mentioned first embodiment, it has been explained that coating the surface layer of the high conductive resilient member (silicon) with fluorine resin such as Polytetrafluoroethylene (PTFE) or the like can prevent the high conductive resilient member (silicon rubber) being attacked by organic solvent, organic acid or the like emitted from surface active agent or an emulsion layer of the film surface layer when the film is developed. Consequently, it is possible to prevent deterioration of the resilient member such as silicon rubber or the like for long time, and to obtain stable finished image quality.

As mentioned above, by coating the resilient member surface with the fluorine resin, it is possible to achieve long life of the heating drum and cleaning maintenance cycle extension of the heating drum. Furthermore, a method for solving problems peculiar to fluorine resin as follows, will be explained.

(1) Shortage of conveyance force due to the low friction coefficient (2) Development failure due to low conductivity through the coated layer (3) growth of electro static charge due to high volume resistivity The above-mentioned problem (1) will be explained hereafter. Polytetrafluoroethlene (PTFE) is low friction coefficient material capable of being used as a sliding unit, as is well known. Therefore, when the nip pressure of the opposed roller placed around the heating drum is in the same condition as one of the heating drum with the resilient member of silicon rubber, conveyance force during thermal development drastically decreases, and that may result in film slip. Consequently, the film slip causes extension of an entire development period practically. This may cause density shift, crease or damage on the surface of the film.

Since quantity of development (sum of added heat energy) on the thermal development photosensitive film is determined by (heating temperature)×(heating time), if constant heating time, in other word, conveyance speed from the beginning to the end of the film is not maintained, density unevenness happens. Therefore, in the thermal development apparatus in an earlier art, comprising the heating drum comprising the surface layer made of the resilient member of silicon rubber, in order to prevent density unevenness and crease unevenness, an equation regarding conveyance speed at the thermal development unit and upstream and downstream side of the thermal development unit, is established as follows: (Upstreamside conveyance speed)<(thermal development unit conveyance speed)<(downstreamside conveyance speed). Generally, in order to increase the conveyance force, the N (nip pressure) out of $\mu$N has to be increased. However, if the roller's weight and/or increase of the biasing force of a spring cause an effect on image quality or film conveyance (due to curvature of the opposed roller in direction of film width), a method for driving forcefully a part of the rollers to rotate by a gear, may be used.

The above-mentioned problem (2) will be explained hereafter. The thermal development apparatus for effectively supplying heat energy to the thermal development photosensitive film to obtain desired finished density and prevent photographic fog on film, is achieved by developing and conveying the film on the high conductive resilient member (silicon rubber) while the opposed roller biases the film on the surface of the resilient member. However, since fluorine resin such as Polytetrafluoroethylene (PTFE) or the like, has approximately one-third as much conductivity as an high conductive resilient member in an earlier art, development failure (lower density) may happen due to too much thickness and therefore it is not possible to obtain desired density.

Further, when the film is nipped between the opposed roller and the heating drum with the silicon rubber layer on its surface, even if parallelism between the heating drum and the opposed rollers in axis direction of the heating drum is out of alignment in some measure, the rubber resilient member is still capable of making the film evenly and uniformly contact both the heating drum and the opposed roller. On the other hand, in case the surface layer is coated with fluorine resin such as Polytetrafluoroethylene (PTFE) or the like, when nip pressure and the parallelism are in the same condition as one in the case of the heating drum with the silicon rubber layer, the film may not evenly and uniformly contact both the sides. Therefore, combined with the problem (1), it is important to optimize the biasing force and the alignment between the heating drum and the opposed roller, with more emphasis than the earlier art.

The above-mentioned problem (3) will be explained. Since fluorine resin has lower dielectric constant than silicon rubber or the like, generated electro static charge amount is not too large. However, since it is insulating material having volume resistivity more than $10^{18}$ Ω cm, a half-life period of the generated electro static charge amount is enormously long. Further, since fluorine resin is located furthermost in triboelectric series, electro static charge can easily happen. Therefore, it is revealed that the electro static charge amount on the fluorine resin surface is more than that on the resilient member (silicon rubber) surface and further, the leading edge of the film, while being separated from the heating drum, may gradually take a closer path to the drum when the surface is fluorine resin than when it is silicon rubber.

Further, the film for thermal development exposure generally comprises a emulsion layer and a base layer such as PET. Since thickness of the film is approximately 200 $\mu$m including the emulsion layer and the film is at high temperature by heat when the film passes the last opposed roller, the path of the leading edge of the film is hardly influenced by an aspect ratio of a film size but is determined depending on the electro static charge amount on the drum surface, as proved by experiments of the present inventors or the like.

Hereinafter, a second embodiment of the present invention for solving the above-mentioned problem 3 will be explained with figures.

Figure 7:
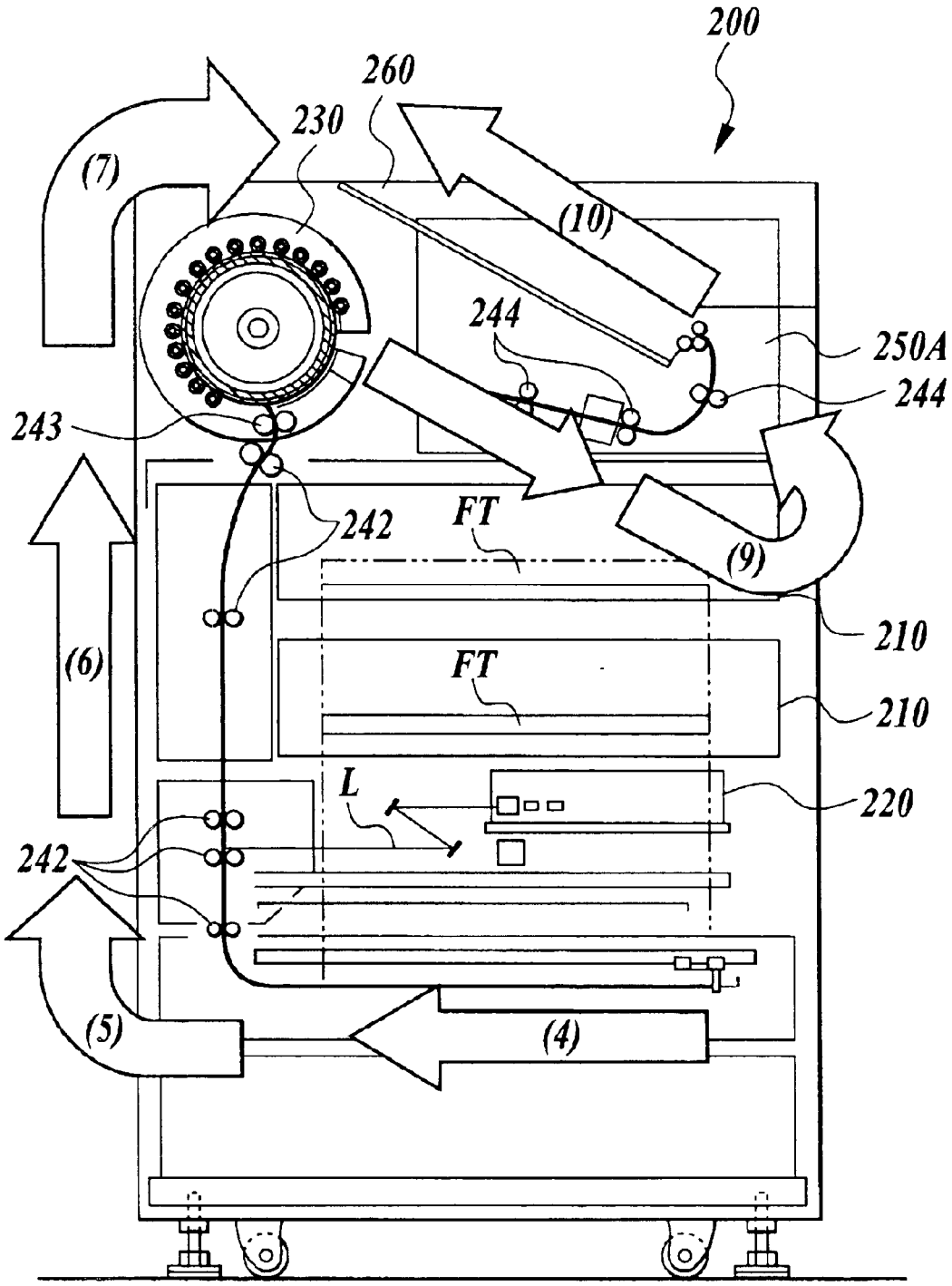
FIG. 7 is a front sectional view schematically showing a thermal development apparatus 200 according to a second embodiment of the present invention.
Figure 8:
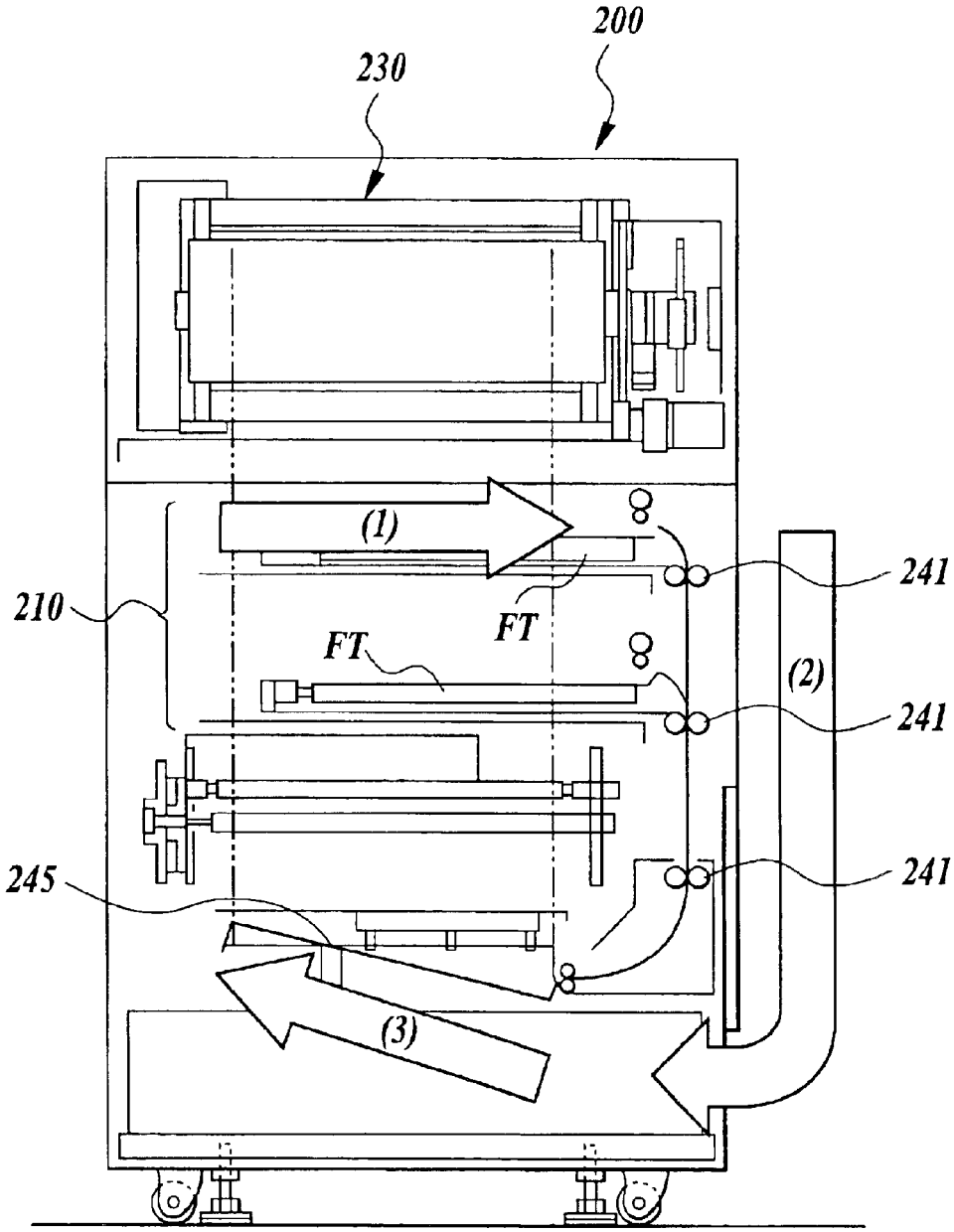
FIG. 8 is a left side sectional view showing the thermal development apparatus 200 shown in FIG. 7.

FIG. 7 is a front sectional view schematically showing a thermal development apparatus 200 of the second embodiment of the present invention. FIG. 8 is a left side sectional view showing the thermal development apparatus 200 shown in FIG. 7.

As shown in FIGS. 7 and 8, the thermal development apparatus 200 has approximately the same structure as the thermal development apparatus 100 shown in FIG. 1 according to the first embodiment. Concretely, the thermal development apparatus 200 comprises: a feeding unit 210 for feeding the thermal development photosensitive film F (hereafter, it is also called "film F") as sheet-like thermal development photosensitive material, one by one at a time; an exposure unit 220 for exposing the fed film F; and a thermal development unit 230 for developing the exposed film F. With reference to FIGS. 7 and 8, the thermal development apparatus 200 will be explained.

As shown in FIG. 8, the feeding unit 210 has two levels, above and below, for containing containing trays FT within which sheets of the film F are contained. A film drawing unit, not shown in FIG, draws the film F from the containing tray FT in direction of an arrow (1) (horizontal direction) shown in FIG. 8. Further, the film f drawn from the containing tray FT is conveyed by a conveyance roller pair 241 in direction of an arrow (2) (downward) shown in FIG. 8.

When the film F conveyed underneath the thermal development apparatus 200 is further conveyed to a conveyance direction changing unit 245 placed underneath the thermal development apparatus 200, the conveyance direction changing unit 245 changes conveyance the direction of the film F (an arrow (3) shown in FIG. 8 and an arrow (4) shown in FIG. 7), and the film F is shifted to be at an exposure preparation phase. Further, while the film F is conveyed from a left side of the thermal development apparatus 200 in direction of an arrow (5) shown in FIG. 7 (upward) by a conveyance roller pair 242, the exposure unit 220 scans and exposes the film with a laser beam L within infrared range from 780 nm to 860 nm.

A latent image is established within the film F by irradiating the laser beam L. After that, the conveyance roller pair 242 conveys the film F in direction of an arrow (6) (upward) shown in FIG. 7. When the film F arrives at a supply roller pair 243, the supply roller pair 243 supplies the film F to a heating drum D. In other words, the supply roller pair 243 supplies the film F to the heating drum D at random timing. Further, it is also possible that when the film F arrives at the supply roller pair 243, the supply roller pair 243 stops its rotation once. In this case, the supply roller pair 243 comprises a function for determining supply timing of the film F to the heating drum D which rotates at a constant rotating speed in the thermal development unit 230. Concretely, it is possible that the supply roller pair 243 starts rotating when the heating drum D rotates so that a next supplied position of the heating drum D on its surface reaches a predetermined position to the supply roller pair 243 at rotation of the heating drum D, for supplying the film F on the periphery of the heating drum D. A motor 251 drives the supply roller pair 243 to rotate under control of a control apparatus 250.

Further, the heating drum D rotates in direction of an arrow (7) shown in FIG. 7, while keeping the film F on its periphery. In this state, the heating drum D heats the film F for thermal development, which results in a visual image from the latent image. After that, when the heating drum D shown in FIG. 7 rotates till the right, the film F is separated from the heating drum D and conveyed in a direction of an arrow (8) shown in FIG. 7 to a cooling conveyance unit 250A for being cooled down. After that, a plurality of conveyance roller pairs 244*a* (shown in FIG. 11) and 244 conveys the film in direction of arrows (9) and (10) shown in FIG. 7 to an ejection tray for ejecting the film F from the top of the thermal development apparatus 200.

Figure 9:
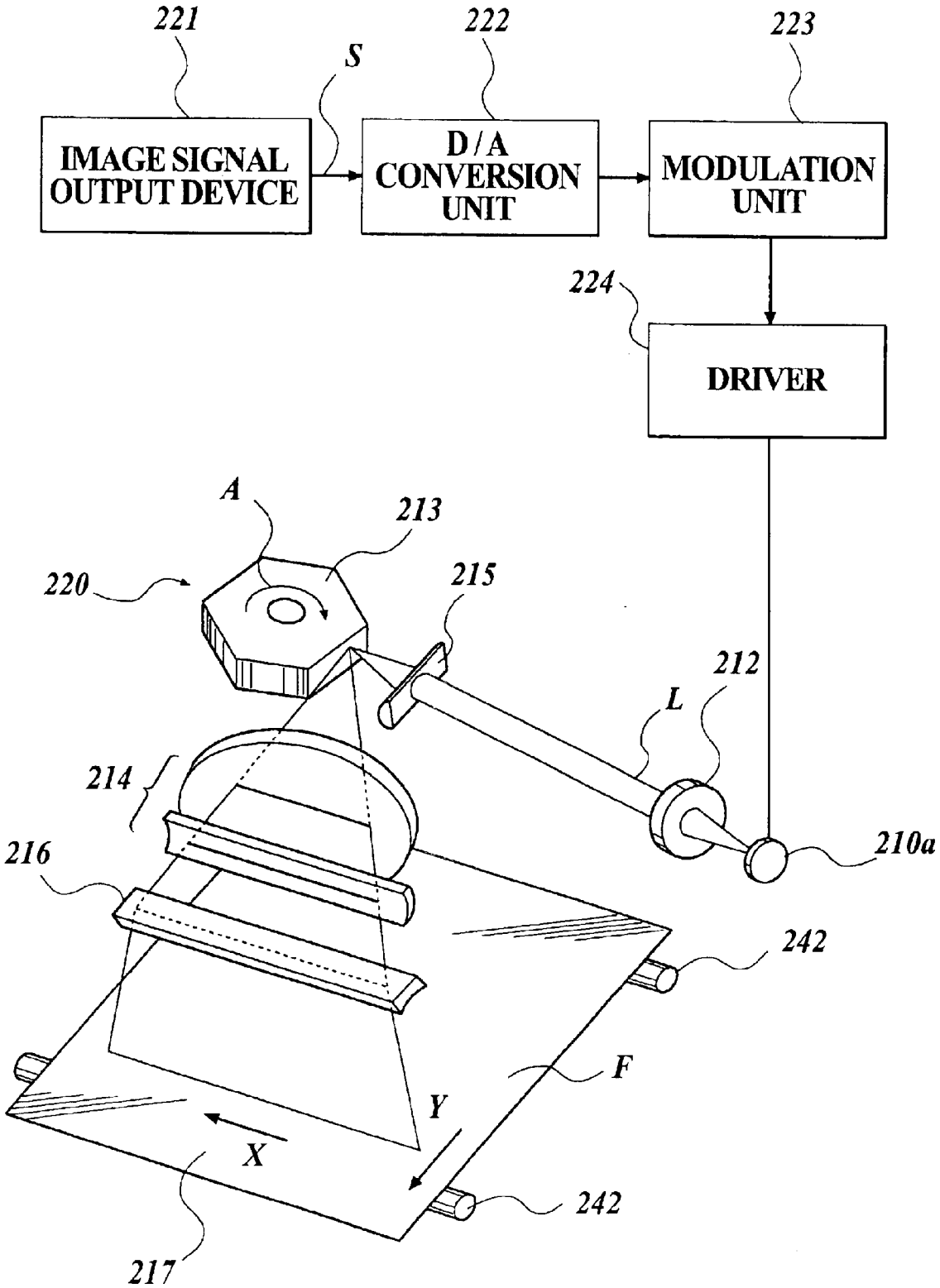
FIG. 9 is a view schematically showing a structure of an exposure unit 220 shown in FIG. 7.

FIG. 9 is a view schematically showing a structure of the exposure unit 220. The exposure unit 220 main-scans the film F by deflecting the laser beam L whose intensity is modulated based on an image signal S on a rotation polygonal mirror 213 rotating in direction A as shown in FIG. 9. The exposure unit 220 also sub-scans the film F by relatively moving the film F in orthogonal direction toward the main-scanning direction of the laser beam L. Consequently, the latent image is established within the film F by irradiating the laser beam L.

More detailed structure of the exposure unit 220 will be explained hereafter. In FIG. 9, the image signal S which is a digital signal outputted from an image signal output device 221, is converted into an analogue signal by a D/A converter 222, and then inputted in a modulation circuit 223. The modulation circuit 223, based on the analogue signal, controls a driver 224 of a laser source unit 210*a* to make the laser source unit 210*a* irradiate the modulated laser beam L.

The laser beam L irradiated from the laser source unit 210*a*, after passing through a lens 212, is converged in only vertical direction by a cylindrical lens 215. Then, the converged laser beam L is injected toward the rotation polygonal mirror 213 rotating in direction of an arrow A in FIG. 9, as a line image orthogonal to a drive shaft of the mirror. The rotation polygonal mirror 213 deflects the laser beam L by reflecting in the main-scanning direction. The deflected laser beam, after passing through an fθ lens 214, which is a combination of 2 lenses including a cylindrical lens, is reflected by a mirror 216 provided so as to extend on a light path in the main-scanning direction. Then, a scanned area of the film conveyed in direction of an arrow Y (sub-scanning direction) by the conveyance roller pair 242 is repeatedly main-scanned in direction of an arrow X by the conveyance roller pair 244. In other words, the scanned area 217 of the film F is entirely scanned with the laser beam L.

The cylindrical lens of the fθ lens 214 converges the laser beam L injecting the scanned area 217 of the film F only in sub-scanning direction. Further, distance between the fθ lens 214 and the scanned area 217 is equal to entire focal length of the Fθ lens 214. As mentioned above, since the exposure unit 220 comprises the Fθ lens 214 including the cylindrical lens and the mirror 216 for converging the laser beam L only in sub-scanning direction once on the rotation polygonal mirror 213, even when there is a slant on a face or deviation of an axis at the rotation polygonal mirror 213, it is possible to form a scan line at an equal pitch without deviating a scanning position of the laser beam L to sub-scanning direction. The rotation polygonal mirror 213, for example, a galvanometer mirror or the like, has advantage in scan stability compared with other beam deflectors. As mentioned above, the latent image based on the image signal S is established within the film F.

Figure 10:
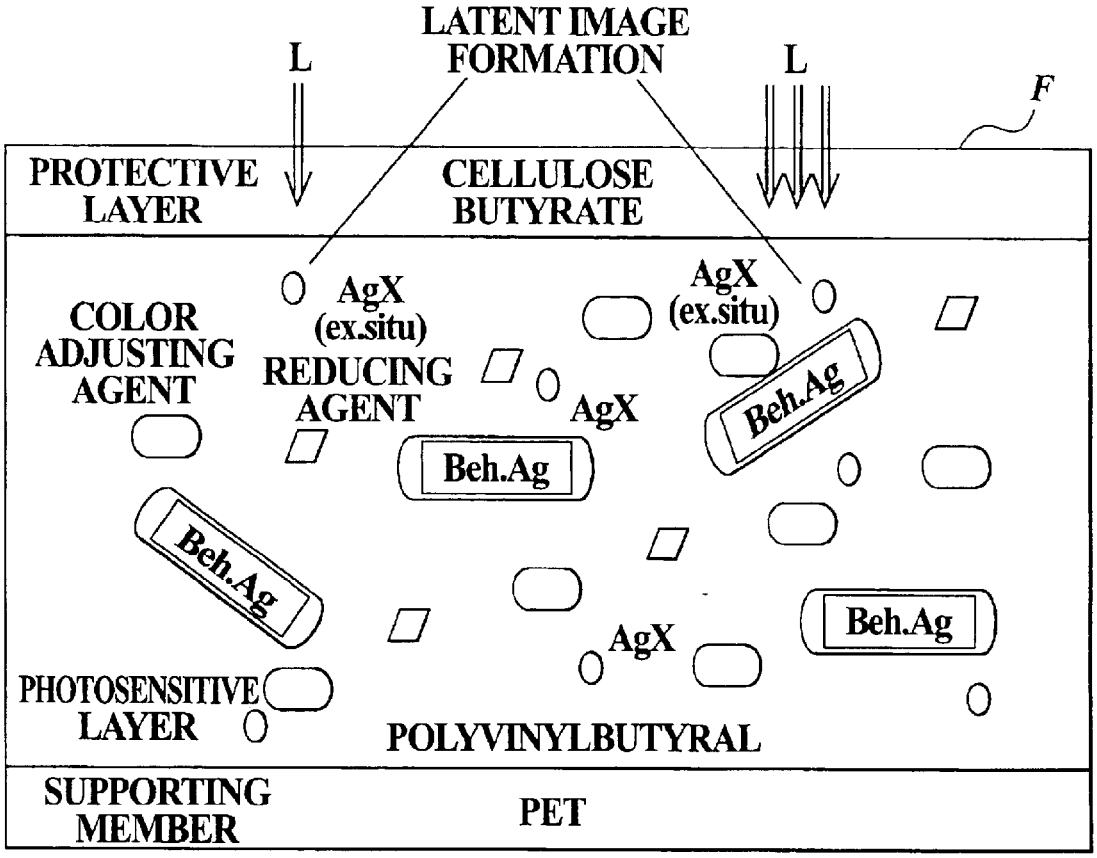
FIG. 10 is a sectional view briefly showing chemical reaction within the thermal development photosensitive film F at exposure with a laser beam.

Concrete detail of chemical reaction for establishing the latent image as described above, will be explained with reference to FIG. 10. FIG. 10 is a sectional view showing the film F made of the thermal development material, as well as a view briefly showing chemical reaction within the film F at exposure.

The film F comprises a photosensitive layer whose main component is thermostable binder, formed on a supporting member made of PET and a protective layer whose main component is thermostable binder is formed on top of the photosensitive layer. Within the photosensitive layer, a silver halide particle, silver behenate (Beh. Ag) which is a type of silver organic acid, reducing agent and color adjusting agent are blended. Further, at a backside of the supporting member, a backside layer whose main component is thermostable binder is also formed.

When the laser beam L is irradiated on the film F from the exposure unit 220 upon exposure, as shown in FIG. 10, the silver halide particle is exposed within an area to which the laser beam L is irradiated, as a result, the latent image is established.

Figure 11:
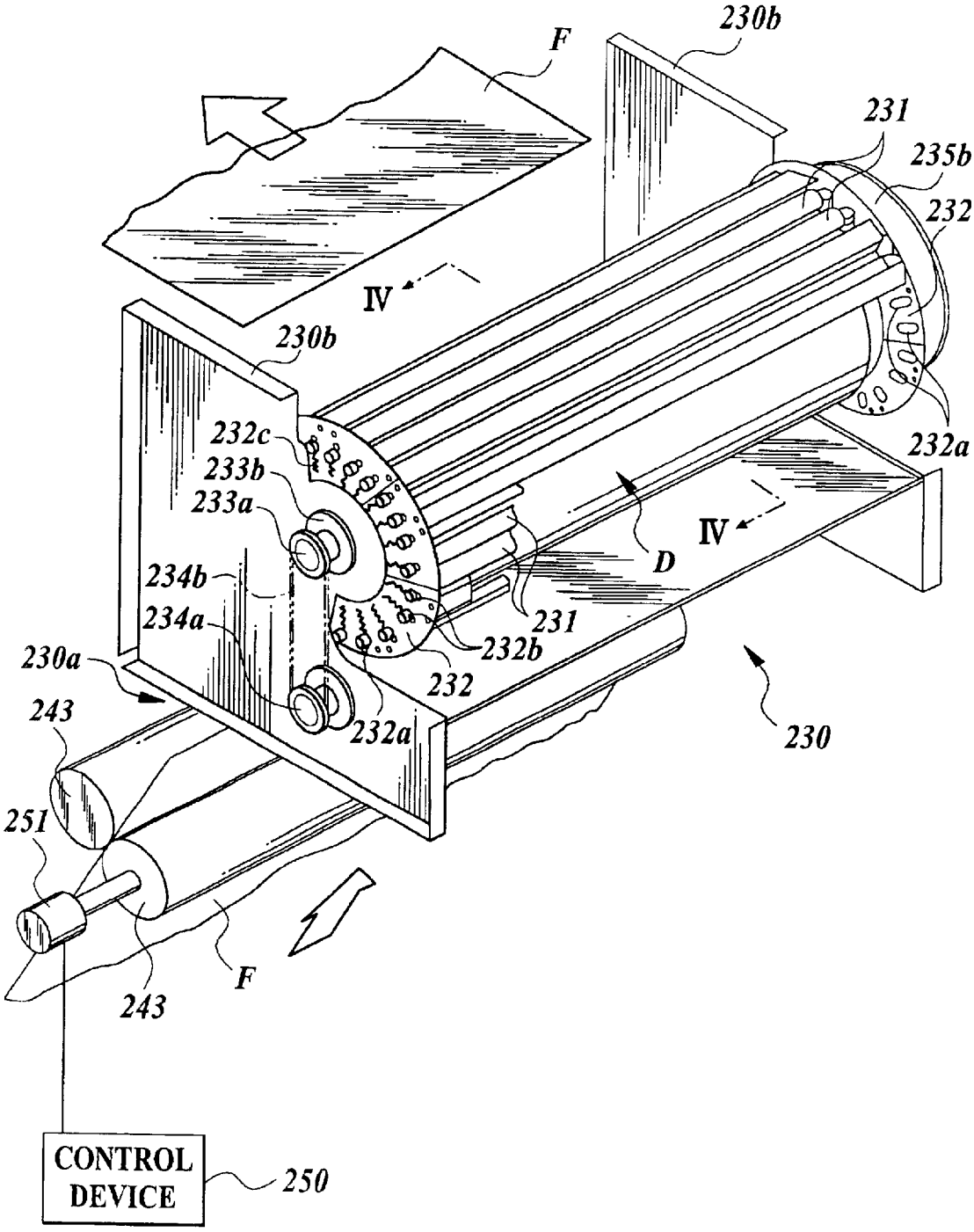
FIG. 11 is a perspective view showing a structure of a thermal development unit 230 shown in FIG. 7.
Figure 12:
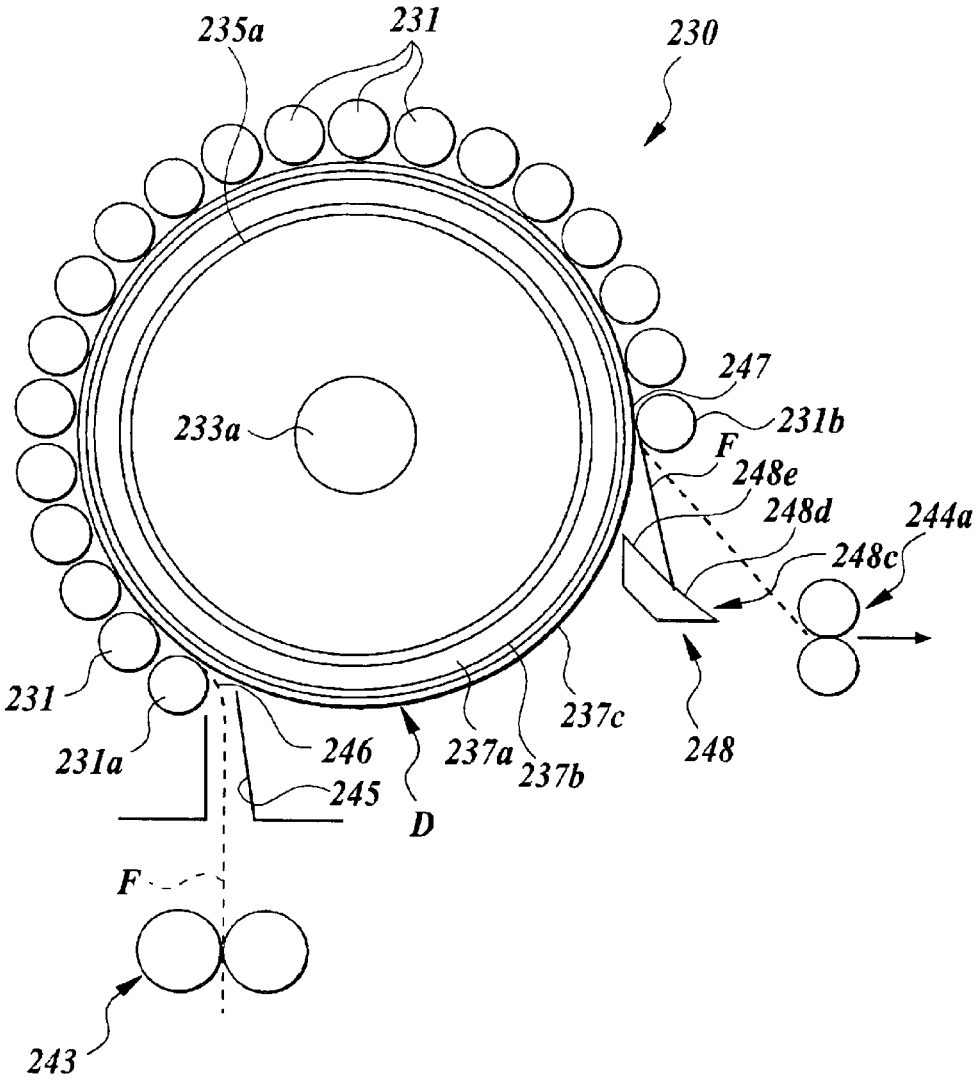
FIG. 12 is a sectional view showing a substantial part of a structure of FIG. 11 viewed in of an arrow of IV—IV line.
Figure 13:
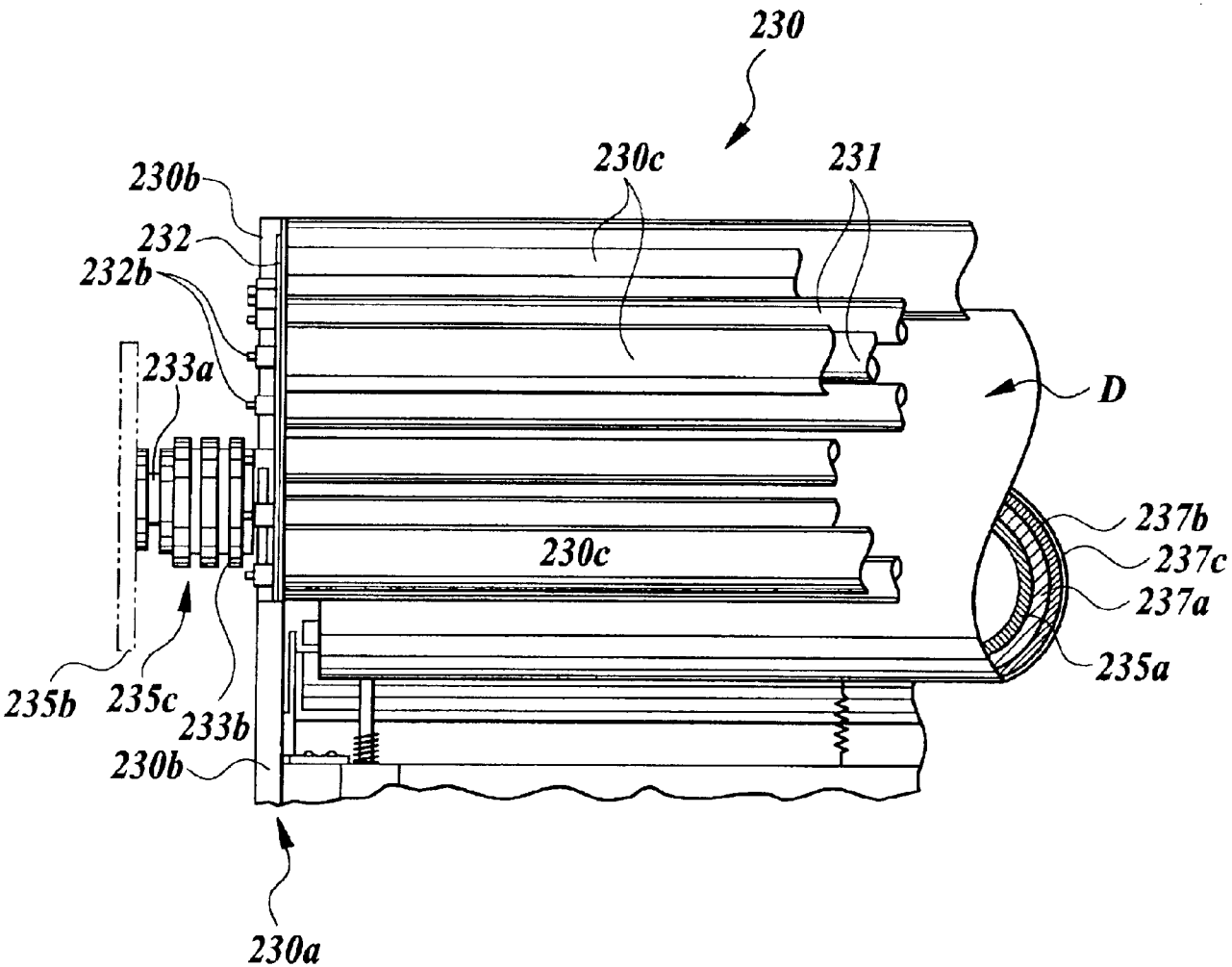
FIG. 13 is a front view showing the structure shown in FIG. 11.
Figure 14:
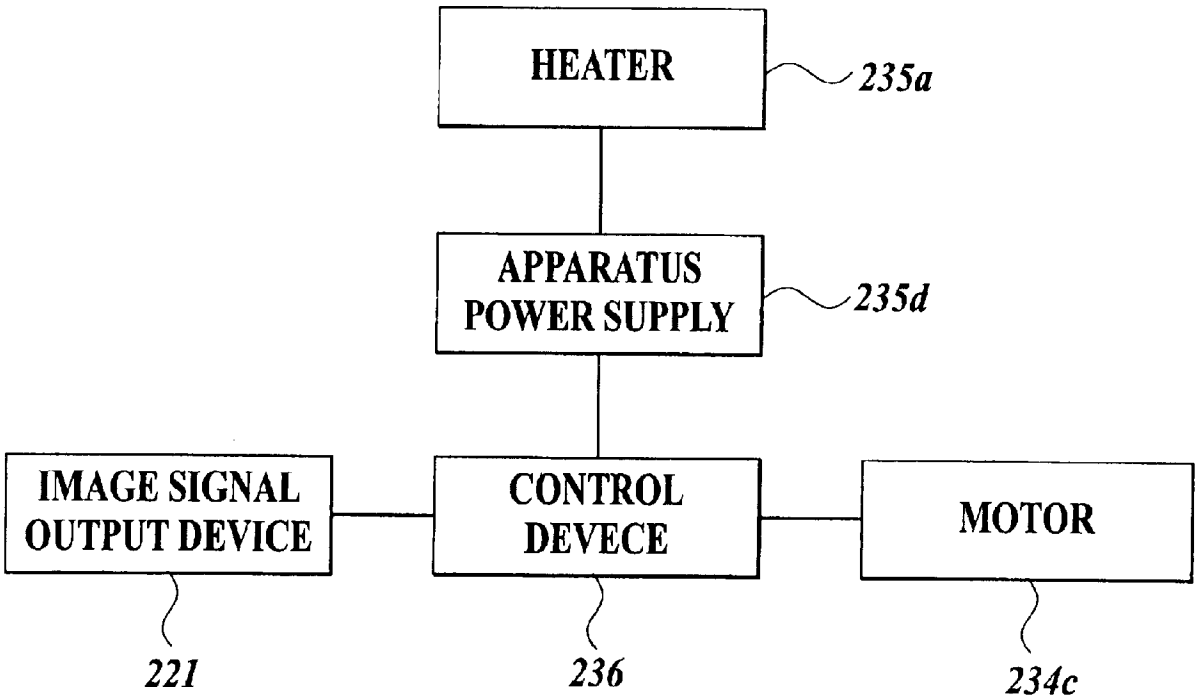
FIG. 14 is a block diagram showing a control system of a motor 234*c* driving a heating drum D of the thermal development unit 230 shown in FIG. 7 to rotate.

FIGS. 11, 12 and 13 are views showing a structure of the thermal development unit 230 for heating the film F. More concretely, FIG. 11 is a perspective view showing the thermal development unit 230, FIG. 12 is a sectional view showing the structure shown in FIG. 11 viewed in direction of an arrow of line IV—IV, and FIG. 13 is a front view showing the structure shown in FIG. 11. Further, FIG. 14 is a block diagram showing a control system of a motor driving the heating drum D shown in FIG. 11 to rotate.

The thermal development unit 230 comprises the heating drum D as a heating component for heating the film F and maintaining adhesion of the film F on its periphery simultaneously. The heating drum D has a function for forming the visual image from the latent image established within the film F, by maintaining the film F at temperature higher than a predetermined lowest thermal development temperature for a predetermined thermal development period. Here, the lowest thermal development temperature means lowest temperature at which thermal development starts happening on the latent image established within the film F. At the film of the present embodiment, it is equal to or higher than 80° C. On the other hand, the thermal development period means a time period for which the film F should be maintained at temperature higher than the lowest thermal development temperature for developing the latent image within the film F into desired development property. Furthermore, preferably the film F is not substantially thermal-developable under 40° C.

Figure 15:
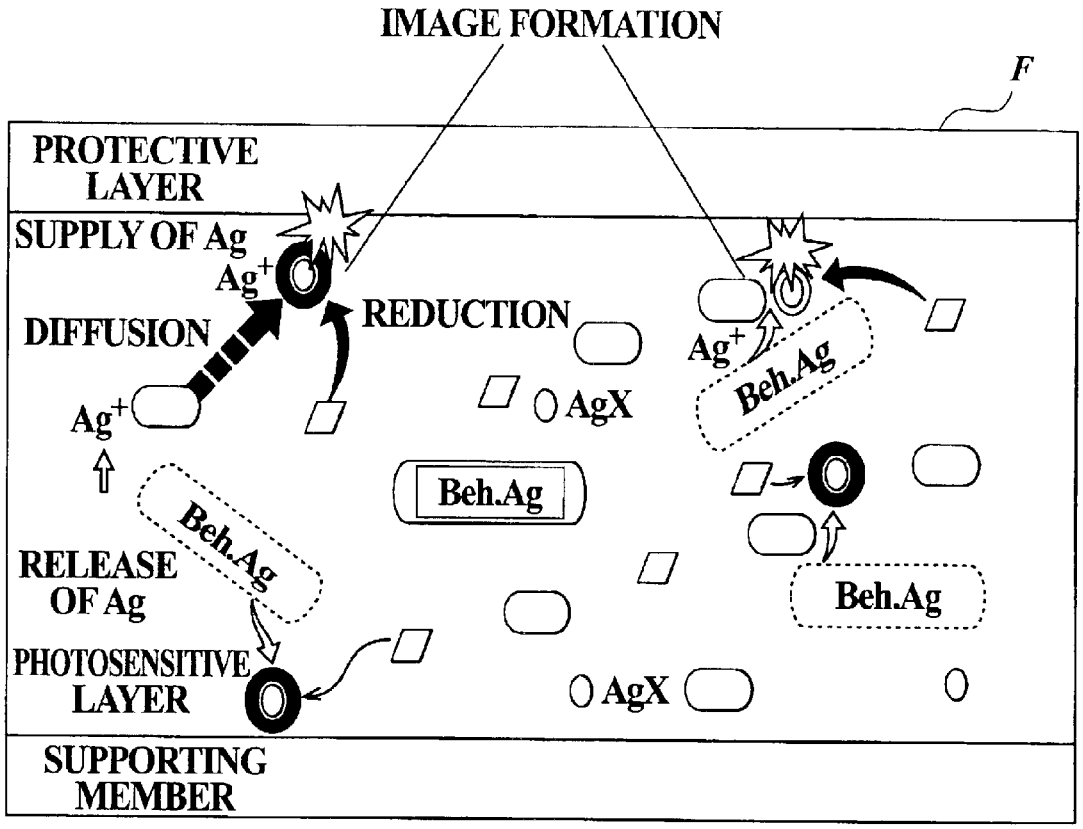
FIG. 15 is a cross sectional view briefly showing chemical reaction within the thermal development photosensitive film F shown in FIG. 10 when the thermal development photosensitive film F within which a latent image is established is heated.

Concrete detail of chemical reaction wherein the latent image is visualized by heat as mentioned above, will be explained with reference to FIG. 15. FIG. 15 is a sectional view briefly showing chemical reaction within the film F when the film F is heated, as well as FIG. 10 as mentioned above.

When the film is heated and goes over the lowest thermal development temperature, as shown in FIG. 15, silver ion (Ag+) is emitted from the silver behenate. Then, behenic acid which emitted the silver ion is combined with the color adjusting agent into complex. After that, it is considered that the silver ion is spread out and reacted to the reducing agent with the exposed silver halide particle as a core, as a result the chemical reaction forms a silver image. As mentioned above, the film F comprises: photosensitive silver halide particle; organic silver salt; and silver ion reducing agent. Further, thermal development cannot happen on the film F practically when its temperature is under 40° C., but can happen at temperature higher than the lowest thermal development temperature which is higher than 80° C.

Furthermore, according to the present second embodiment, although the thermal development unit 230 and the exposure unit 220 are corporated in the thermal development apparatus 200, the thermal development unit 230 may be an independent apparatus of the exposure unit 220. In that case, preferably there is a conveyance unit for conveying the film F from the exposure unit 220 to the thermal development unit 230.

Outside of the heating drum D, as both a guide component and an opposed component, a plurality of opposed rollers 231 are placed along with each other as opposed to the heating drum D and in the axis direction on the surface of the heating drum D at an equal interval. The plurality of opposed rollers 231 have small diameters, and are either driven to rotate by force or rotated with following the rotation of the heating drum D. As the opposed roller 231, a steel tube having a diameter of outer periphery of 1 cm to 2 cm and thickness of 2 mm, is used.

Three guiding brackets 232 supported by a frame 230*a* are combined so as to be formed in a C-shape around each end of the heating drum D as opposed to the others.

The guiding bracket 232 holds a plurality of opposed rollers 231 at both its ends integrally, and it is possible to adjust a holding position of the opposed roller 231 to the heating drum D by the guiding bracket 232. In other words, by adjusting a position of the guiding bracket 232, alignment of the plurality of opposed rollers 231 toward the heating drum D can integrally be adjusted. Accordingly, since it is possible to appropriately adjust parallelism in the axis direction of the heating drum D between the heating drum D and each opposed roller 231, the film F can evenly and uniformly contact the outer periphery of the heating drum D. Especially, when the smooth layer such as fluorine resin or the like is used on the outer periphery of the drum D as follows, the deviated parallelism easily causes density unevenness. However, it is possible to realize a structure capable of preventing the density unevenness by the structure wherein the parallelism is adjustable.

At each guiding bracket 232, nine long holes 232*a* extending itself in its radius direction are formed. Through the long hole 232*a*, a shaft 232*b* placed at each end of the opposed roller 231 projects. The one end of each coil spring 232*c* is attached to the shaft 232*b*, and the other end of each coil spring 232*c* is attached near an internal fringe of the guiding bracket 232. Therefore, each opposed roller 231 is biased against the outer periphery of the heating drum D with a predetermined force based on a biasing force of each coil spring 232*c*. When the film F advances between the outer periphery of the heating drum D and the opposed roller 231, the predetermined force biases the film F against the outer periphery of the heating drum D. As a result, the film F is entirely and evenly and uniformly heated.

The shaft 233*a* concentrically connected with the heating drum D, is placed extendedly over an end component 230*b* of the frame 230*a*. With support of a shaft bearing 233*b*, the shaft 233*a* is rotatable against the end component 230*b*. A gear is formed at a rotation axis 234*a* of a micro step motor 234*c* (not shown in FIGS.) placed below the shaft 233*a* and attached to the end component. A gear (not shown in FIGS.) is also formed at the shaft 233*a* with a timing belt 234*b* (a belt with a gear) connecting both the gears. Through the timing belt 234*b*, power created from the micro step motor is transmitted to the shaft 233*a* for rotating the heating drum D. Here, for the power transmission from the rotation axis 234*a* to the shaft 233*a* may be through a chain or a gear array instead of the timing belt.

Figure 16:
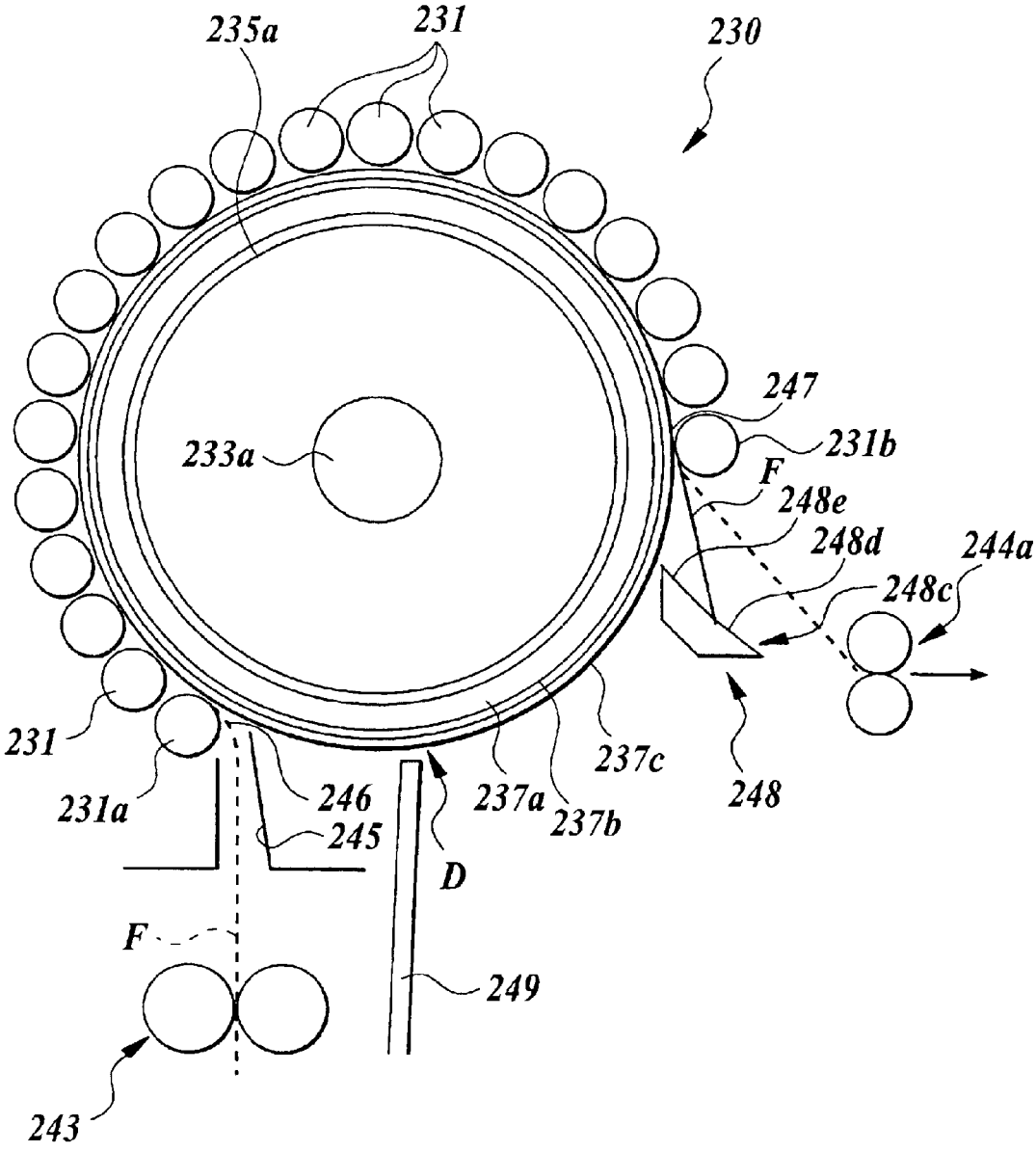
FIG. 16 is a view showing a state where an electro static charge removal member 249 is placed near heating the drum D.

As shown in FIG. 12, in the present embodiment, the opposed roller 231 is placed in the axis direction on the surface of the heating drum D. Further, two reinforcement components 230*c* (shown in FIG. 13) connect both the end part components 230*b* of the frame 230*a* for additionally supporting both the end part components 230*b*. Each opposed roller 231 is grounded through the guiding bracket 232 or the like. Therefore, each opposed roller 231 can reduce its own electro static charge amount. Here, the heating drum D may reduce its own electro static charge amount through an electro static charge removal member 249 such as a static charge removal brush grounded as shown in FIG. 16.

At the inner periphery of the heating drum D, a plate-shaped heater 235*a* is placed all around. Under control of an electronic apparatus 235*b* as shown in FIG. 13, the outer periphery of the heating drum D is heated by the heater 235*a*. Electric power is supplied to the heater 235*a* through a slip ring assembly 235*c* connected to the electronic apparatus 235*b*.

The heater 235*a* is placed at the inner periphery of the heating drum D for heating the outer periphery of the heating drum D. The heater 235*a* for heating the heating drum D can apply, for example, a foil heater having etched foil resistance part.

The electronic apparatus 235*b* for controlling the heater is rotated along with the heating drum D and can adjust the power supply to the heater 235*a* based on temperature information detected by a temperature detecting section placed at the heating drum D. The electronic apparatus 235*b* controls the heater 235*a* for adjusting outer periphery temperature of the heating drum D to be appropriate for developing the specific film F. In the present embodiment, the heating drum D can be heated at up to 60° C. to 160° C.

Here, a range of temperature variance in width direction of the heating drum D is preferably maintained within 2.0° C. (especially within 1.0° C.) by the heater 235*a* and the electronic apparatus 235*b*. In the present embodiment, it is maintained within 0.5° C.

As shown in FIG. 14, the thermal development apparatus 200 shown in FIG. 7 comprises: the micro step motor 234*c* for driving the heating drum D to rotate by transmitting power through the rotation axis 234*a*, the timing belt 234*b* and the shaft 233*a* as mentioned; an apparatus power supply 235*d* for energizing the heater 235 of the heating drum D or the like; and a control apparatus 236 for controlling the motor 234*c*, the apparatus power supply 235*d* and so on. When the control apparatus 236 receives the image signals outputted from the image signal output apparatus 221 as shown in FIG. 9 for establishing the latent image within the film for thermal development, the control apparatus 236 controls the motor 234*c* for rotating the heating drum D at predetermined rotation speed. When the control apparatus 236 does not receive the image signals therefore there is no print requirement, the control apparatus 236 controls the motor 234*c* for rotating the drum D at lower speed. Further, at a warm-up phase, when the apparatus power supply 235*d* is turned on therefore development is not yet possible, the control apparatus 236 controls the motor 234*c* for rotating the heating drum D at lower speed as well.

As shown in FIG. 12, the heating drum D comprises: a supporting tube 237*a*, rotatable, in a cylindrical shape and made of aluminum; a resilient member 237*b* which is made of soft material such as silicon rubber or the like and placed outside of the supporting tube 237*a*; and a smooth layer 237*c* which is formed as the outermost surface coated with fluorine resin on the resilient member 237*b*.

Thickness and conductivity of the resilient member 237*b* is determined so as to effectively perform a plurality of continuous processes to the film F. Here, the resilient member 237*b* may indirectly be attached with the supporting tube 237*a*.

As fluorine resin coated to form the smooth layer 237*c*, for example, a chemical compound such as Polytetrafluoroethylene (PTFE), Polychlorotrifluoroethylene (PCTFE), Polyvinylidene Fluoride (PVDF), copolymer of Tetrafluoroethelen and Perfluoroalkoxyiethylene (PFA), copolymer of Ethylene and Tetrafluoroethylene (ETFE), Tetrafluoroethylene and Hexafluoropropylene (FEP) or the like is used.

When the film is heated around the heating drum D for thermal development, gas including chemical component such as organic acid or the like is emitted. However, since fluorine resin, comprised in the smooth layer 237*c* placed on the surface of the resilient member 237*b*, has resistance to chemical reaction, chemical reaction with the emitted gaseous component such as organic acid or the like which could cause deterioration does not happen. Further, since the fluorine resin prevents the gaseous component such as organic acid or the like from penetrating into the resilient member 237*b*, deterioration or alteration on the resilient member 237*b* is prevented. As a result, since the resilient member 237*b* is prevented from alteration of its shape or property, it is possible to maintain initial resilience and conductivity of the resilient member 237*b*.

Further, since the biasing force of the coil spring 232*c* is to determine amount of pressure of the opposed roller 231 in order to convey the film F surely contacted with the outer periphery of the heating drum D with sufficient amount of heat, value of the biasing force should carefully be selected. That is, if the biasing force of the coil spring 232*c* is too small, unevenly conducted heat on the film F may make development of an image imperfect, and the conveyance of the film may become unstable.

Next, a preferable biasing force of the opposed roller 231 created by the coil spring 232*c* for stably conveying the film F between the heating drum D and the opposed roller 231, will be explained with reference to FIGS. 17 and 20.

Figure 17:
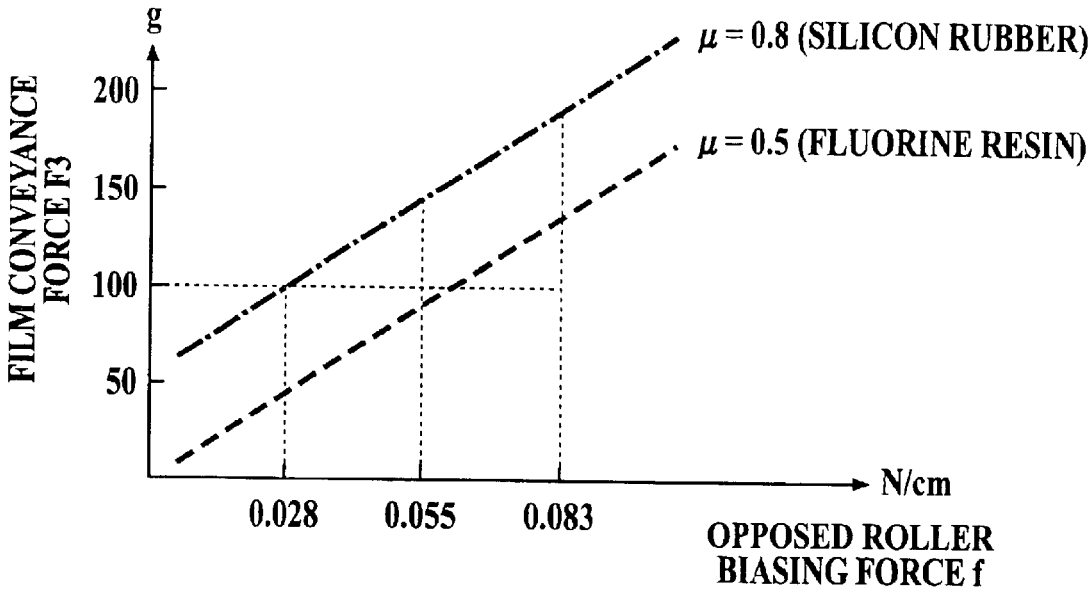
FIG. 17 is a graph showing relationship between a biasing force f from an opposed roller 231 and a film conveyance force F3 of the heating drum D.
Figure 18:
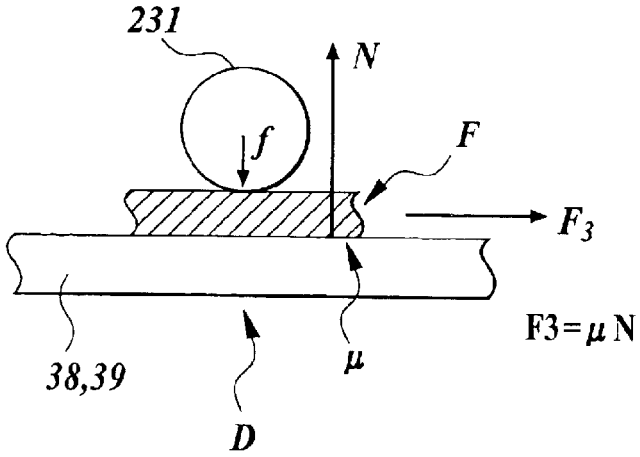
FIG. 18 is a view briefly showing a state where the thermal development photosensitive film F suffers the conveyance force F3 generated with the biasing force f from the opposed roller 231 at the heating drum D.

FIG. 17 is a view showing relationship between the biasing force f of the opposed roller 231 and the conveyance force F3 of the film F. FIG. 18 is a view briefly showing a state where the film F suffers the conveyance force F3 created by the biasing force f from the opposed roller 231. Further, the FIG. 17 shows a case that a friction coefficient $\mu$ between the resilient member made of silicon rubber and the film F is 0.8, as well as a case that the friction coefficient $\mu$ between the smooth layer 237*c* made of fluorine resin and the film F is 0.5 in the present embodiment.

As shown in FIG. 18, when the film F suffers the biasing force f from the opposed roller 231, the film conveyance force F3 toward the film F occurs. The film conveyance F3 is established with a vertical reaction force N on the outer periphery of the heating drum D caused from the biasing force f, and the friction coefficient $\mu$ between the film F and the smooth layer 237*c* in contact with the film F, as a following equation (2):

$$F3=\mu N \tag{2}$$

Here, preferably the film conveyance force F3 is equal to or more than 100 g for stably conveying the film F contacted with the heating drum D. Since the friction coefficient $\mu$ between the smooth layer 237*c* made of fluorine resin and the film F is approximately 0.5, relationship between the biasing force f per one opposed roller 231 and the film conveyance force F3 is as shown in FIG. 17. As shown in FIG. 17, in order to obtain 100 g of the film conveyance force F3, the biasing force f per one opposed roller 231 needs to be approximately 0.06 N/cm. When the width of the opposed roller 231 is 14 inches, it is necessary to have a force of [0.06 N/cm]×[14×2.54 cm]=2.13 N. Therefore, if the weight of the opposed roller 231 is not heavy sufficiently, adjustment of the coil spring 232 (shown in FIG. 11) influencing both the sides of the opposed roller 231 or the like should be used together.

Therefore, preferably the biasing force which is a sum of a force from the coil spring 232 (shown in FIG. 11) biasing each opposed roller 231 on the heating drum D, and its own weight is adjusted to be equal to or more than 0.06 N/cm. On the other hand, considering necessity to make the biasing force of the opposed roller 231 too small to cause a dent on the film F, the biasing force should be within the range from 0.06 to 1 N/cm. Further, according to the present inventor's more investigation, preferably the biasing force is within the range from 0.1 to 1 N/cm, for effectively supplying heat from the heating drum D and improving adhesion between the smooth layer 237*c* made of fluorine resin and the film F Since the film F being developed can move at approximately the same speed as the heating drum, damage such as scratch or the like on the surface of the film F is prevented and a higher quality image can be assured. The film F developed after being conveyed between the heating drum D and the opposed roller 231, is conveyed to the nip unit 247 formed between the last opposed roller 231*b* located at the most downstream part where the film F is about to be separated and the heating drum D. Then, as it will be explained later, the film F is drawn from the heating drum D of the thermal development unit 230.

The thermal development unit 230 is structured for, for example, developing the film F wherein photosensitive thermal development emulsion including infrared photosensitive silver halide is coated on 0.178 mm of PET (Polyethylene Terephthalate) as the supporting member. The heating drum D is maintained at 115° C. to 138° C., for example, at 124° C. The heating drum D is driven to rotate at rotation speed for keeping the film F contacted with its outer surface for about 15 seconds as predetermined. Temperature of the film F is gone up to 124° C. for the predetermined period at the predetermined temperature. Here, glass-transition temperature of PET is approximately 80° C.

Figure 19:
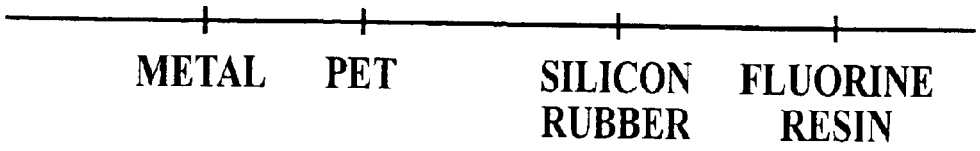
FIG. 19 is a view schematically showing triboelectric series of various kinds of material of a resilient member 181 according to the second embodiment.

Next, an effect from the rotation speed of the heating drum D controlled by the control device 236 shown in FIG. 14, will be explained with reference to FIG. 19. FIG. 19 is a view schematically showing triboelectric series of various kinds of material used in the present embodiment.

The control device 236 shown in FIG. 14 controls the motor 234*c* to drive the heating drum D to rotate at lower speed when the film F is not conveyed for the predetermined period such as there is no external input of the image signal or while being at a warm-up period after turning the apparatus power supply 235*d* on, than when it is conveyed.

That is, when the heating drum D rotates in contact with the plurality of opposed rollers 231, electrification caused by separation between the film F and the opposed rollers is repeated as many times as the number of the opposed rollers 231. The longer the heating drum D rotates, the more amount of electro static charge results. Further, the faster the heating drum D rotates, the more times electrification caused by separation happens, therefore more amount of electro static charge is accumulated. In this case, the smooth layer 237*c* which is the outermost surface of the heating drum D, made of fluorine resin such as Polytetrafluoroethylene (PTFE) or the like, is almost electrically insulated. Therefore, it is easiest to happen electro static charge against metal, and it is easier to accumulate electro static charge amount than silicon rubber (the resilient member 237*b*) or metal according to triboelectric series shown in FIG. 19. However, as described above, since the control apparatus 236 controls the rotation speed of the heating drum D, it is possible to reduce the amount of the electro static charge by rotating the heating drum D at the lower speed when thermal development does not happen. As a result, it is possible to stably convey the film F by reducing the amount of electro static charge between the heating drum D and the plurality of opposed rollers 231.

Further, since the opposed roller 231 is grounded, generated electro static charge can be discharged to the ground from the opposed roller 231. As a result, it is possible to reduce the amount of electro static charge occurred in the heating drum D and the opposed roller 231.

Next, a guide component 248 for firstly guiding the film F separated from the heating drum D shown in FIG. 12, will be explained with reference to FIG. 20. FIG. 20 is a front view showing a substantial part of the guide component 248 placed near the heating drum D shown in FIG. 12.

Figure 20:
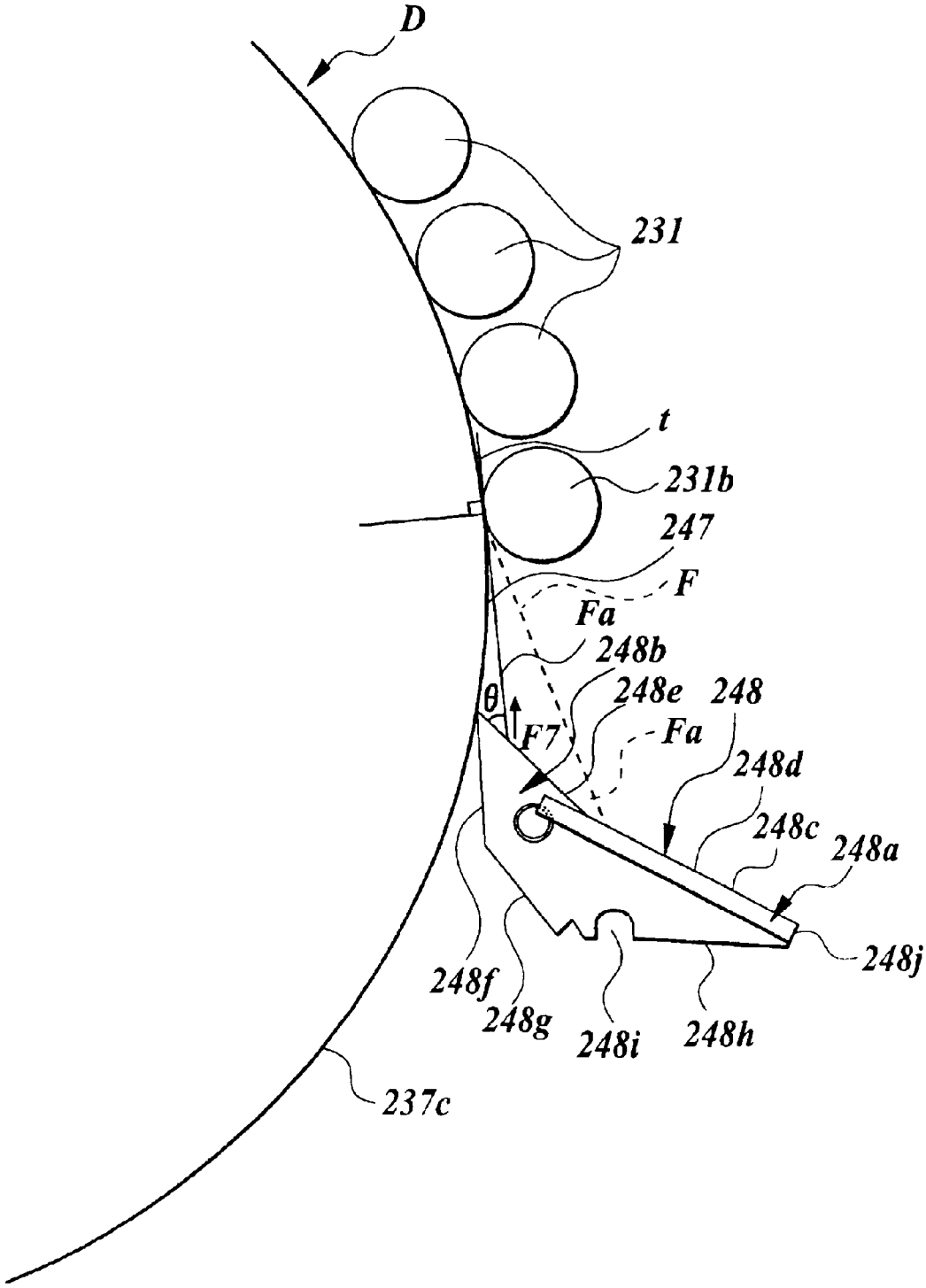
FIG. 20 is a front view showing a substantial part of a guide component 248 placed near a downstream side of the heating drum shown in FIG. 12.

As shown in FIGS. 12 and 20, the guide component 248 for separating the developed film F from the heating drum D and guiding it in the direction along the conveyance, is placed between the heating drum D and a conveyance roller pair 244*a* below a pilot component 231*b* placed at the most downstream. In other words, the guide component 248 is placed in order for a guide face 248*c* to firstly guide the film F after the film F is conveyed between the heating drum D and the opposed roller 231 and separated from smooth layer 237*c* which is the outermost surface.

As shown in FIG. 20, the guide component 248 comprises: a first component 248*a* made of thermostable material such as resin material or nonwoven fabric; and a second component 248*b* made of conductive metallic material such as aluminum, integrally placed underneath the first component 248*a*. The guide face 248*c* comprises: a first guide face 248*e* of the second component 248*b* with which the film F is firstly in contact; and a second guide face 248*d* of the thermostable first component 248*a* with which the film F is secondly in contact.

Further, the guide component 248 comprises: a first inclined face 248*f*; a second inclined face 248*g*; and a third inclined face 248*h* at the opposite side of the guide face 248*c*. The first inclined face 248*f*, the second inclined face 248*g* and the third inclined face 248*h* are formed in series as their inclination angles continuously change from downward gravity direction to oblique direction in order from the heating drum D.

The first inclined face 248*f* of the guide component 248 is placed nearest the heating drum D at the opposite side to the guide face 248*c*. The first inclined face 248*f* is inclined in the gravity direction so as to be more separated from the smooth layer 237*c* of the heating drum D. The second inclined face 248*g* goes in the oblique direction toward the gravity direction. The third inclined face 248*h* goes in substantially the vertical direction.

As shown in FIG. 20, a right end of the third inclined face 248*h* is near an ejection 248*j* of the guide face 248*c* for the film F. Further, a liquid pool 248*i* is formed in a ditch shape in the middle of the third inclined face 248*h*. Roughness of a surface of the ditch of the liquid pool 248*i* is formed as: Ra is equal to or more than $1\mu$ and Rz is equal to or more than $10\mu$.

Since in the guide component 248 shown in FIG. 20, the opposite face to the guide face 248*c* of the guide component 248 placed nearest the heating drum D, consists of the first, second and third inclined faces 248*f*, 248*g* and 248*h* as an inclined structure overall, even if the film F emits gas by being heated by the thermal development unit 230 and the emitted gas is repeatedly agglutinated and remelt to make stain, the stain does not come near the smooth layer 237*c* of the heating drum D. Therefore, damage on the heating drum D is prevented. Further, if the gas is repeatedly agglutinated and remelt into liquid, it streams from the second inclined face 248*g* to the third inclined face 248*h* for preventing growth of the stain. As a result, damage on the smooth layer 237*c* of the heating drum D is prevented.

In the thermal development apparatus 200 shown in FIG. 7, although, the film F emits gas such as higher fatty acid or the like during the development process of the film F, the film F in a softened state after the thermal development can stably be conveyed to a cooling conveyance unit 250A by the guide component 248 shown in FIG. 20 placed near the heating drum D.

A guide component made of metallic material in an earlier art is easy to be cooled down after development process stops. Therefore, when gas such as fatty acid or the like is emitted from the film or the like, not only is it easy to agglutinate the gas into stain, but the once agglutinated gas is also remelt to make a large pool upon another process start. By repeating this phenomenon, the pool is grown up large enough to be in contact with the heating drum to cause damage on the heating drum. On the other hand, in the guide component 248 as shown in FIG. 20, since the opponent surface of the guide surface 248*c* has the inclined structure inclined so as to be more separated from the smooth layer 237*c* of the heating drum D, even if the gas such as fatty acid or the like emitted upon the film development process is agglutinated and adheres to the first inclined face 248*f* or the like, damage on the heating drum D is prevented.

Further, when the gas is repeatedly agglutinated and remelt into liquid and it streams on the second inclined face 248*g* and the third inclined face 248*h*, the liquid stops at the liquid pool 248*i* placed on the third inclined face 248*h*. Then, since it starts dropping itself due to gravity before it grows up more than predetermined amount, the cleaning cycle of the guide component 248 can be extended. In other words, it is possible to obtain a desirable result that the heating drum D is less necessary to go under maintenance for cleaning up the stain with alcohol or the like for preventing damage caused by agglutinated stain than the earlier art. Further, since the first, second and third inclined faces 248*f*, 248*g* and 248*h* which are the opposite faces to the guide face 248*c*, are inclined, it is easy to do the maintenance operation to clean up.

Further, since the second guide face 248*d* of the guide face 248*c* is formed so as to be insulated from fluorine resin material or nonwoven material of the first component 248*a*, the heated film F cannot rapidly be cooled down. Therefore, the heated film F in a softened state does not adhere to the guide face 248*c* as an obstruction to conveyance. Further, when the conductive second component 248*b* is rapidly cooled down after the thermal development process, the gas around the component is agglutinated and adheres to the second component 248*b*. As a result, since an adhering position of the gas is controllable, it is effective to prevent damage on the heating drum D as mentioned above.

As shown in FIG. 20, when the film F comes out from the nip unit 237 between the opposed roller 231*b* located at the most downstream and the heating drum D along with the rotation of the heating drum D, the film comes to contact with the first guide face 248*e* of the guide component 248 as a full line shown in FIG. 20. Then, a leading edge Fa of the film F advances on the second guide face 248*d* while changing its direction as a dotted line shown in FIG. 20. After that, as shown in FIG. 12, when the film F is held by the nip unit between rollers of a rotating roller pair 244*a* as a dotted line shown in FIG. 12, the film F is separated from the guide component 248 as shown in the dotted line in FIG. 12 and is conveyed into the cooling conveyance unit 250A as shown in FIG. 7.

At the conveyance process of the film F shown in FIGS. 12 and 20 as mentioned above, relationship between conveyance speed V1 of the film F by the thermal development unit 230, and a conveyance speed V2 of the film F at a downstream side of the thermal development unit 230 (by the cooling conveyance unit 250A) is established as V1<V2 preferably for stably conveying the film F.

Further, relationship between a conveyance force F5 of the film F conveyed by the smooth layer 237*c* of the heating drum D and a group of the opposed rollers 231, and a conveyance force F6 of the film F at a downstream side of the thermal development unit 230 (by the cooling conveyance unit 250A) is established as F5>F6 preferably. Therefore, the film can stably be conveyed, as well as it is possible to assure a given thermal development period while maintaining given tension on the film at a process for cooling down the film F to a glass transition point at the cooling conveyance unit 250A. As a result, it is possible to obtain a stable image with finished image quality without crease or curl.

Further, as the full line shown in FIG. 20, a conveyance resistance force F7, when the film F comes to contact with the first guide face 248*e* of the guide component 248, is preferably smaller than the conveyance force F5 to the film F by the thermal development unit 230. Further, it is preferably equal to or smaller than 100 g for preventing image unevenness.

Figure 21:
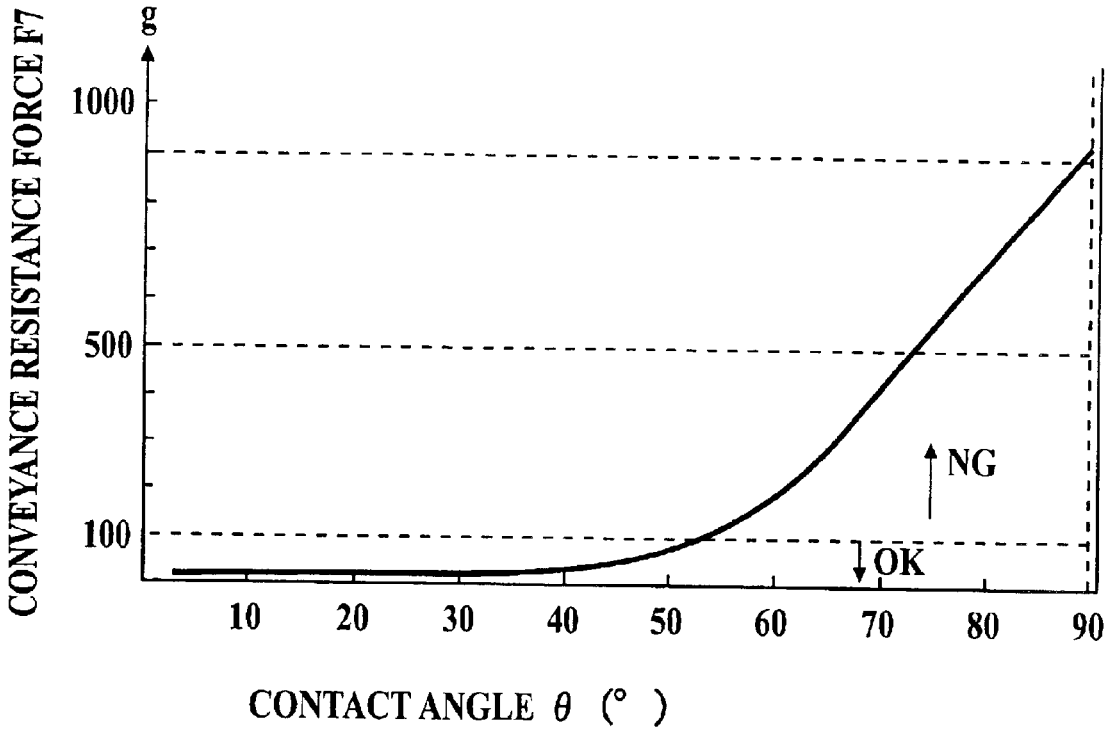
FIG. 21 is a view showing relationship between a conveyance resistance force F7 affected by a side of a first guide face 248*e* of a guide component 248 when the thermal development photosensitive film F is in contact with the first guide face 248*e*, and a contact angle θ of the thermal development photosensitive film F to the first guide face 248*e*.

FIG. 21 is a view showing relationship between the conveyance force F7 which the film F suffers from the side of the first guide face 248*e* when the film F comes to contact with the first guide face 248*e* of the guide component 248, and a contact angle θ of the film F to the first guide face 248*e*.

As shown in FIG. 20, when the film F comes out from between the heating drum D and the opposed roller 231*b* located at the most downstream, the film F is located on a tangent t of the outer surface of the heating drum D and the opposed roller 231*b*. Then, the conveyance resistance force F7 changes its weight according to the contact angle θ formed by the tangent t (the leading edge Fa of the film F) and the first guide face 248*e* as shown in FIG. 21. Therefore, as shown in FIG. 20, the contact angle θ is preferably equal to or less than 50° as the conveyance resistance force F7 becomes equal to or less than 100 g, and the contact angle θ is also preferably equal to or more than 10°. Further, length of the film F which is in contact with the first guide face 248*e* is preferably equal to or less than 5 mm. The guide component 248 is placed as the contact angle θ against the heating drum D is 10° to 50°.

Further, since the contact angle θ is equal to or less than 50°, it is possible to contribute for downsizing due to the position of the guide component 248. Further, since the conveyance resistance force does not become too large, it is possible to prevent coat peeling at the leading edge of the film. Here, in order to prevent the coat-peeling at the leading edge of the film, along with the above-mentioned method, it is better to have an unexposed part of 2 mm to 3 mm at the leading edge of the film when the latent image is established within the film F for improving coat intensity between the emulsion and substrate (base).

As described above, it is possible to stabilize the conveyance of the film F at the downstream side of the thermal development unit 230. Therefore, since the path of the conveyance of the film F is stabilized, it is also possible to suppress density decrease which could be caused by overcooling or a curl peculiar to the thermal development process.

Further, if the guide component 248 consists of the part manufactured by pushing out aluminum and nonwoven fabric, when the leading edge Fa of the film F separated from the heating drum D comes to contact with the first guide face 248*e* to be guided, the high-temperature emulsion side is rapidly cooled down, therefore the coat intensity is improved. After that, the leading edge Fa of the film F is guided on the second guide face 248*d* made of nonwoven fabric with following the rotation of the heating drum D. If the contact distance between the film F and the aluminum first guide face 248*e* for conveying the leading edge Fa of the film F is more than 5 mm, overcooling happens and it causes the leading edge Fa to curl largely or the coating near the film cut face to peel. Further, if the film F is conveyed on the nonwoven fabric from the beginning, since posture of the film F which is at high temperature in the softened state separated from the heating drum D is not stable and both the ends of the film F cannot always come to contact simultaneously with nap of the nonwoven fabric, bend or three-dimensional twist can happen easily. As a result, in the present embodiment, the first guide face 248*e* made of aluminum with which the film F comes to contact at the beginning can prevent the three-dimensional twist.

Further, in order to measure a conveyance force of the nip roller as mentioned above, it is necessary to hold the leading edge Fa of the film F with 14-inch width by the nip roller, with the finishing edge of the film F attached to a spring scale or the like, and to drive the nip roller. Then, the force can be measured by reading the spring scale when the film F starts slipping. The conveyance force of 100 g means the value of the spring scale reads 100 g on this occasion. Further, the conveyance force created by the heating drum D and the opposed roller 231 can be measured in the same method.

Further, regarding conveyance resistance of the film F, the film does not move upon a start of pushing the finishing edge of the film F by the spring scale, but the leading edge Fa of the film F starts moving as spring load goes over certain value. The value of the spring load on this occasion is defined as the conveyance resistance force.

Although the present invention has been explained according to the above-mentioned embodiment, it is possible that various changes may be made to the invention without departing technological idea of the present invention. For example, although the thermal development unit 230 is placed in the thermal development apparatus 200 along with the exposure unit 220 according to the embodiment, it may be independent of the exposure unit 220. In this case, it is necessary to have a conveyance unit for conveying the film F from the exposure unit 220 to the thermal development unit 230.

Figure 22:
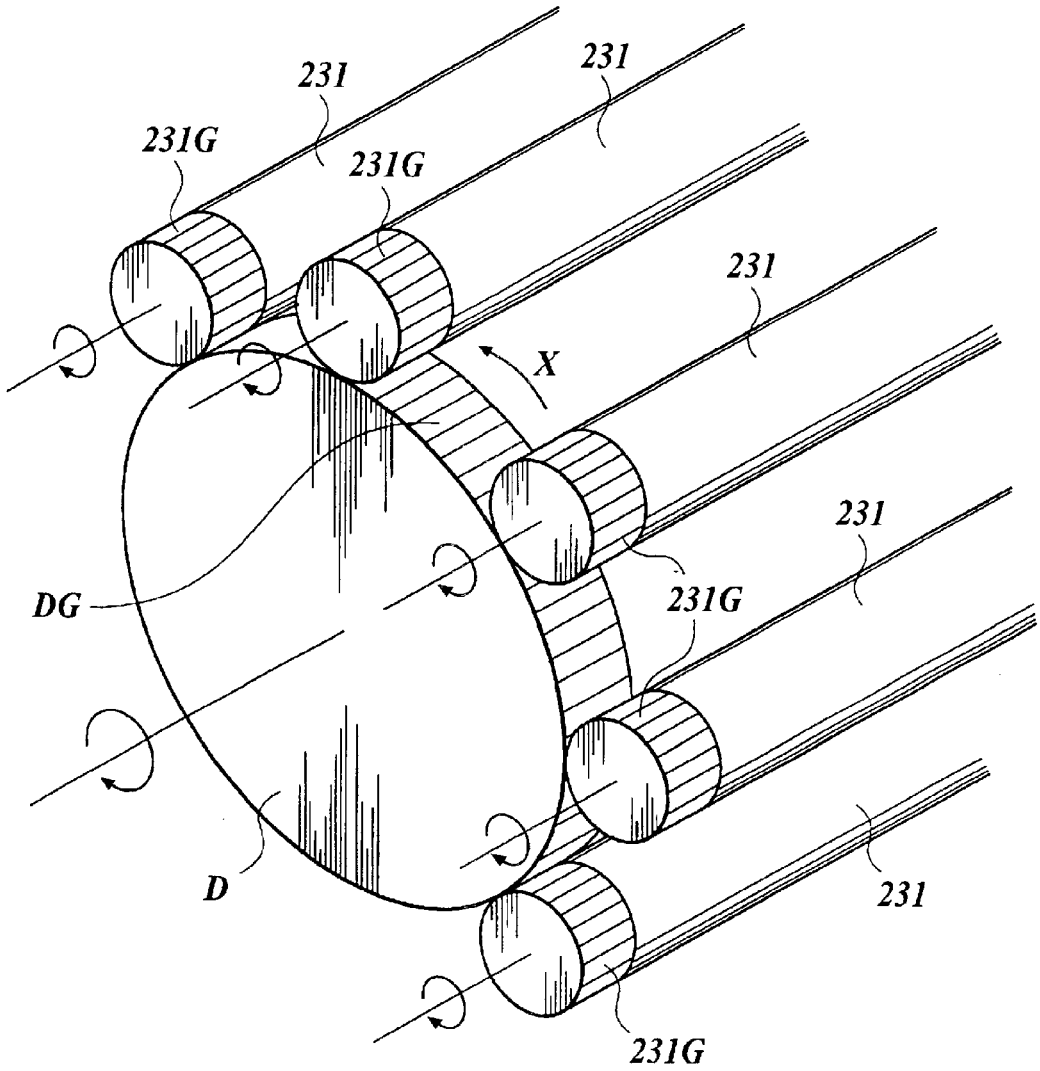
FIG. 22 is a perspective view showing a modified example of an end of the heating drum D and ends of the opposed roller 231 of the second embodiment
Figure 23:
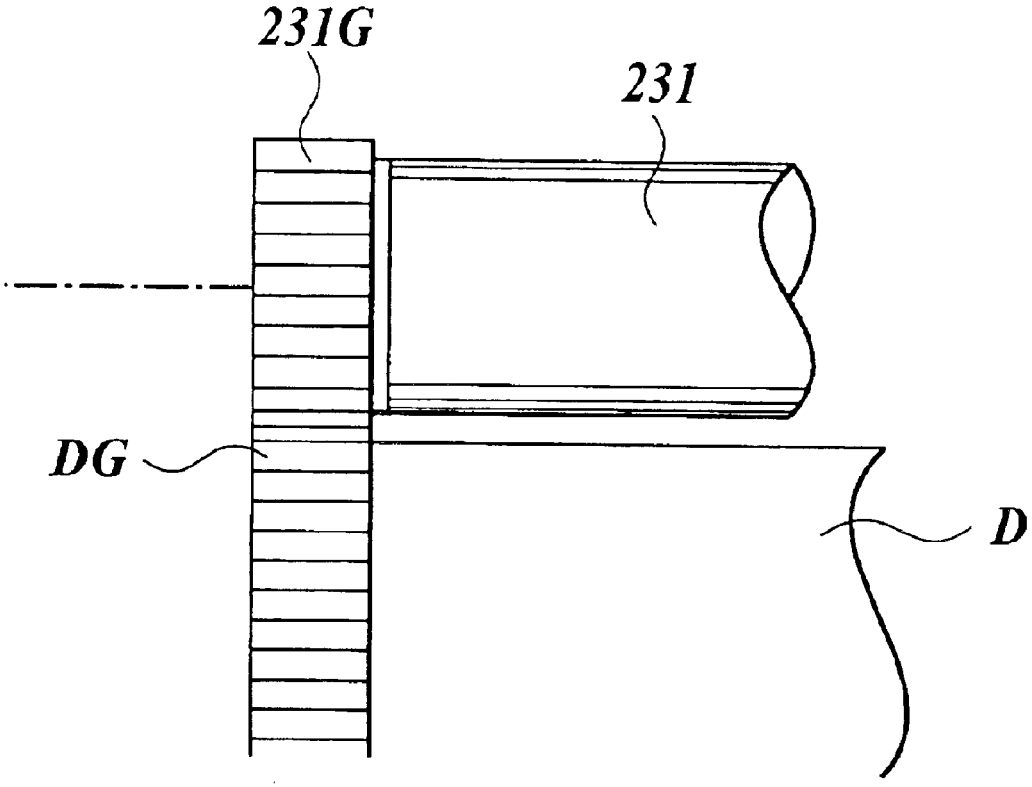
FIG. 23 is a view showing the heating drum D and one opposed roller 231 shown in FIG. 22 viewed in direction of an arrow X shown in FIG. 22.

Further, although each opposed roller 231 is rotated with following the rotation of the heating drum D in the structure shown in FIGS. 11, 12 and 13, the opposed roller 231 may be driven to rotate by force. This case will be explained with reference to FIGS. 22 and 25. FIG. 22 is a perspective view showing the end of the heating drum D and the ends of the opposed roller 231. FIG. 23 is a view showing the heating drum D and one opposed roller 231 shown in FIG. 22 viewed in direction of an arrow X shown in FIG. 22. Further, although five opposed rollers 231 are shown in FIG. 22, all the opposed rollers 231 have the same structures.

Figure 25:
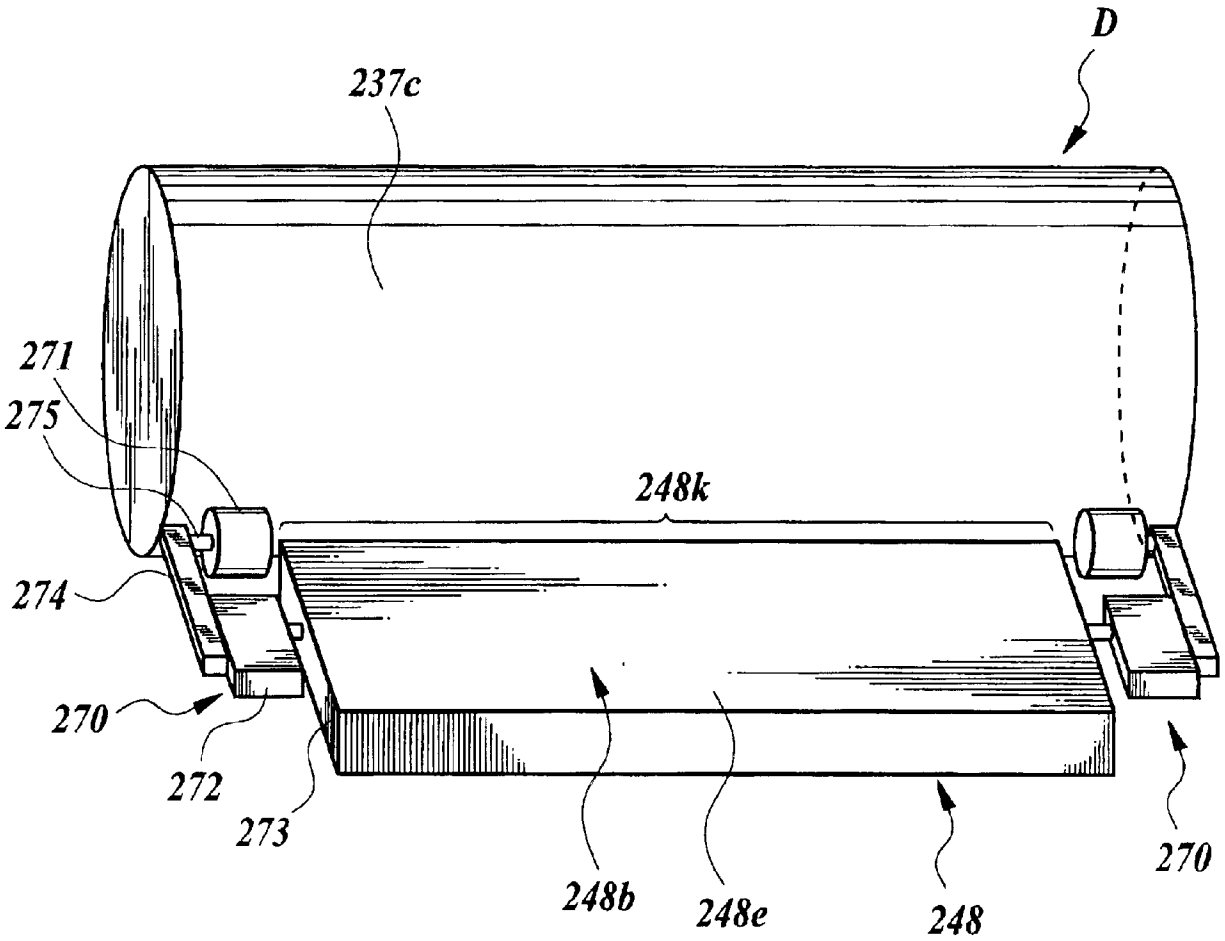
FIG. 25 is a perspective view schematically showing a position regulation component 270 of the guide component 248 shown in FIG. 24.

As shown in FIGS. 22 and 25, a gear tooth 231G is formed at each end of each opposed roller 231, and a gear tooth DG is formed at each end of the heating drum D. By engaging the gear tooth 231G with the gear tooth DG each other, the heating drum D drives each opposed roller 231 through the gear tooth 231G. Therefore each opposed roller 231 is driven to rotate forcedly by the driving force of the heating drum D through the gear tooth 231G and the gear tooth DG without receiving the driving force from the film F. In this case, the film F is stably conveyed despite being conveyed on the smooth layer 237*c* on which the film F could easily slip. On the other hand, when the heating drum D and a plurality of opposed rollers 231 rotate together, amount of electro static charge increases. However, it is possible to stably convey the film with reducing the amount of electro static charge by rotating at low speed when the film F is not conveyed.

According to the thermal development apparatus and the thermal development method in the second embodiment of the present invention, when the heating drum D which heats and conveys the thermal development photosensitive material for development has the smooth layer 237*c* made of fluorine resin or the like thereon, it is possible to reduce the amount of electro static charge as well as to reduce the amount of electrification caused by separation based on the rotation of the opposed roller 231 and the heating drum D. Consequently, it is possible to stably convey the thermal development photosensitive material. Especially, since behavior of the film F is stabilized around the guide component 248 which is a separation pawl for separating the thermal development photosensitive film F from the heating drum D and guiding the film F to the cooling conveyance unit 250 as the next step, it is possible to prevent overcooling of the film F by the cooling conveyance unit 250A and therefore it is possible to obtain density stability.

[Third Embodiment]

The thermal development apparatus 100 in the first embodiment or the thermal development apparatus 200 in the second embodiment as described above, a rotatable roller is placed at each end of the guide component integrally on the heating drum to be rotated with following the rotation of the heating drum in order to maintain relative relation between the guide component for guiding the thermal development photosensitive film F in the predetermined direction after the film F is heated to be separated from the heating drum, and the heating drum. In a thermal development apparatus in an earlier art, the outermost surface of the heating drum is made of silicon rubber as mentioned above, and a roller of metallic bearing is used. Therefore, if either the thermal development apparatus 100 or the thermal development apparatus 200 comprising the heating drum having outermost surface made of fluorine resin adopts the roller of metallic bearing in the earlier art, the roller may not be rotated because of the low friction coefficient on the outermost surface of the heating drum. Further, in this case, since the roller is in contact with the heating drum without being rotated, the roller may peel the fluorine resin layer off, and dust caused from the peeled layer may move to a range (in longitudinal direction of the heating drum D) for forming the image at the heating drum to cause an effect on the image.

Further, since the roller in the earlier art uses the metallic bearing or the like, after the power of the thermal development apparatus is turned off, only the metallic part is rapidly cooled down. Therefore, it is easy to condense fatty acid or the like emitted within the apparatus at thermal development and it ends up adhering to the metallic part as stain. Further, since an outer diameter of the roller grows up with the adhering fatty acid, it may not be possible to maintain predetermined distance between the surface of the heating drum and the guide component.

Figure 24:
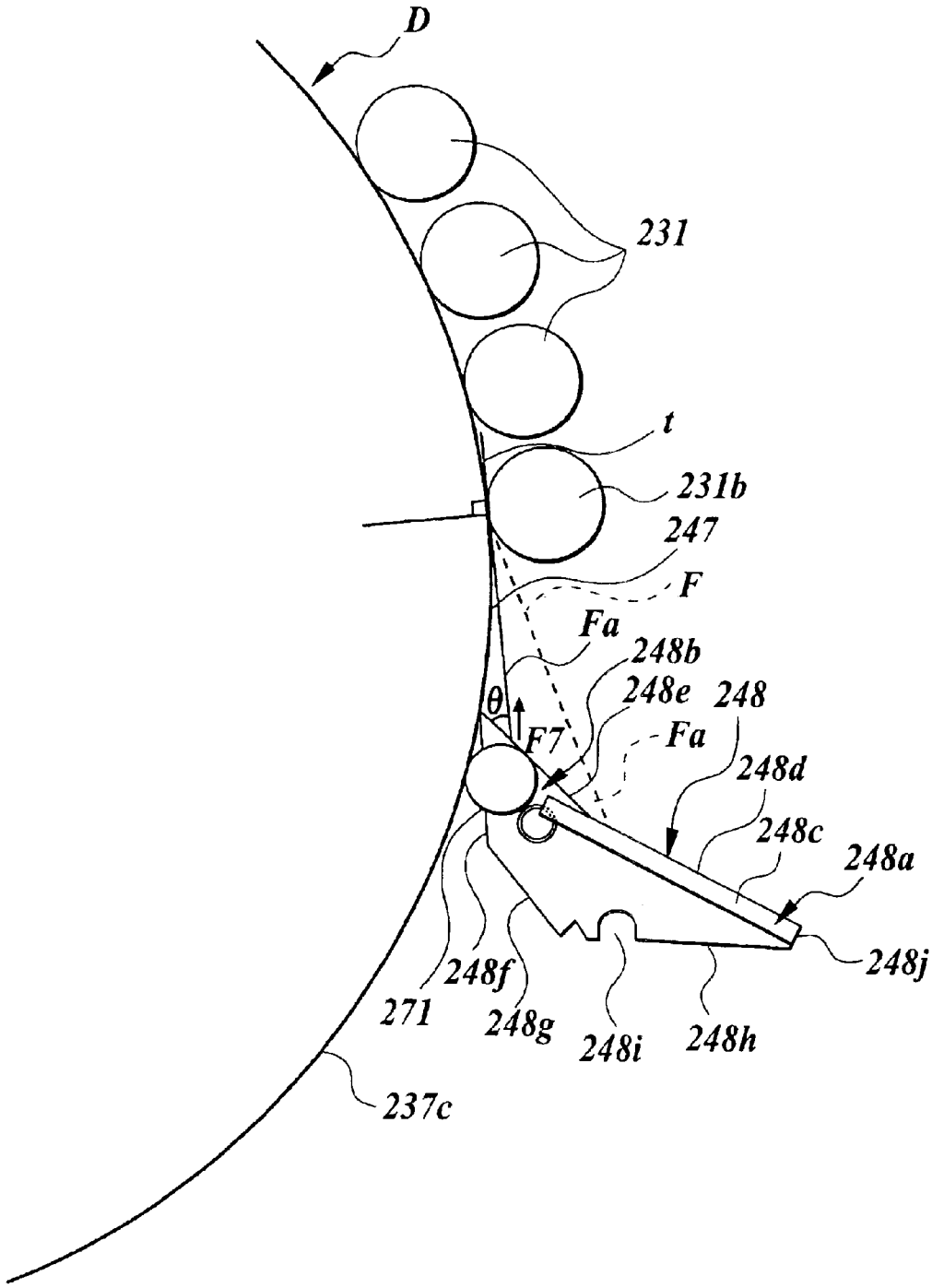
FIG. 24 is a front view showing a substantial part of the guide component 248 placed against the heating drum D and a rotation component 271 of the guide component 248 according to a third embodiment of the present invention.
Figure 26:
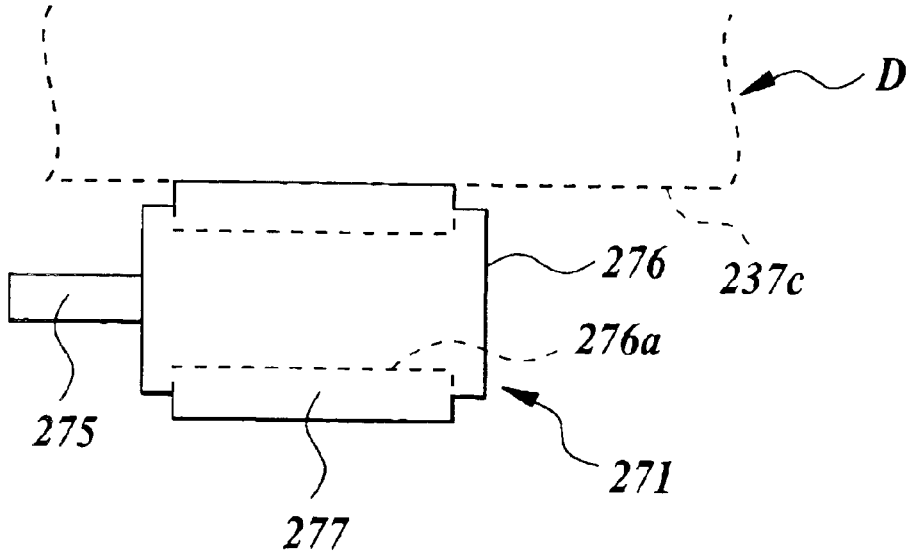
FIG. 26 is a side view showing the rotation component 271 of the position regulation component 270 shown in FIG. 25.

A position regulation component comprised in the guide component, adoptable for either the thermal development apparatus 100 in the first embodiment or the thermal development apparatus 200 in the second embodiment in order to solve the above-mentioned problems, will be explained. According to the third embodiment, the position regulation component adopted to the guide component 248 of the thermal development apparatus 200 in the second embodiment will be explained with reference to FIGS. 24, 25 and 26. FIG. 24 is a front view showing a substantial part of the guide component 248 placed against the heating drum D, and the position regulation component 270 of the guide component 248 as shown in FIG. 20. FIG. 25 is a perspective view schematically showing the position regulation component 270 of the guide component 248 shown in FIG. 24. FIG. 26 is a side view showing a rotation component 271 of the position regulation component 270 as shown in FIG. 25. Here, in FIG. 25, a description of the opposed roller 231 is omitted and the guide component 248 is not shown except for the second component 248*b*.

As shown in FIG. 25, the position regulation component 270 comprises: the rotation component 271, rotatable around a rotation axis 275 in contact with the smooth layer 237*c* which is the outermost layer of the heating drum D as shown in FIG. 24; a fixing component 272 joined to the second component 248*b* of the guide component 248 through a joining axis 273; and a joint component 274 for joining the rotation axis 275 and the fixing component 272 for rotating the rotation component 271. The position regulation component 270 is, as shown in FIG. 25, equally placed at both the ends of the guide component 248 extending in direction along the rotation axis of the heating drum D.

As shown in FIG. 26, the rotation component 271 comprises: a basic body 276 made of metal and formed in a cylindrical shape; and a resilient component 277, in a cylindrical shape. The resilient component 277 is fitted in a groove 276*a* formed at an outer periphery of the basic body 276. The rotation component 271 is placed for bringing the resilient component 277 in contact with the smooth layer 237*c* (shown in a dotted line in FIG. 26) which is the outermost layer of the heating drum D. The resilient member 277 is made of the same material as the resilient member 237*b* of the heating drum D, such as silicon rubber.

As shown in FIG. 25, since the position regulation component 270 is joined to the guide component 248, the resilient component 277 of the rotation component 271 is in contact with the heating drum D for being rotated by following the rotation of the heating drum D. Therefore, it is possible to always maintain a gap between the heating drum D and the guide component 248 thinner than the width of the film, independent of shape accuracy (fluctuation of the outer diameter size, accuracy of drum vibration, drum straightness or the like) of the heating drum D. Consequently, an error such as involving the thermal development photosensitive film F in the heating drum D can surely be prevented.

A friction coefficient between the resilient component 277 made of silicon rubber of the rotation component 271, and the smooth layer 237*c* made of fluorine resin or the like of the heating drum D is higher than one of the case the whole structure of the rotation component 271 is the metallic bearing in the earlier art. Therefore, since the resilient component 277 is in contact with the smooth layer 237*c* of the heating drum D, the rotation component 271 can surely be rotated with following the rotation of the heating drum D. Consequently, it is possible to prevent contact of the rotation component 271 to the smooth layer 273*c* in case the rotation component 271 is not rotated.

Therefore, since the rotation component 271 is not pushed on the heating drum D as much as it is needed, damage such as a scratch, a peeling or the like on the smooth layer 237*c* of the heating drum D can be prevented. Accordingly, deterioration of the heating drum D from the damage on the smooth layer 237*c* can be prevented. As a result, the image of the thermal development photosensitive film F cannot be affected by dirt which is caused from the scratch, the peeling or the like on the smooth layer 237*c* and moves within an image forming width 248*k* (width in the longitudinal direction of the heating drum D shown in FIG. 25).

Further, if the metallic bearing is used as is in an earlier art, after the power of the apparatus is turned off, only the metallic part of the bearing is rapidly cooled down. Therefore, since it is easy to condense fatty acid or the like emitted within the apparatus at thermal development, the outer diameter of the bearing grows up. However, in the third embodiment, since the resilient component 277 made of rubber or the like is placed at the outermost periphery of the rotation component 271 for preventing fatty acid from being condensed and adhering to its surface, it is possible to maintain the gap between the surface of the heating drum D and the guide component 248 as predetermined, as shown in FIG. 24.

Figure 27:
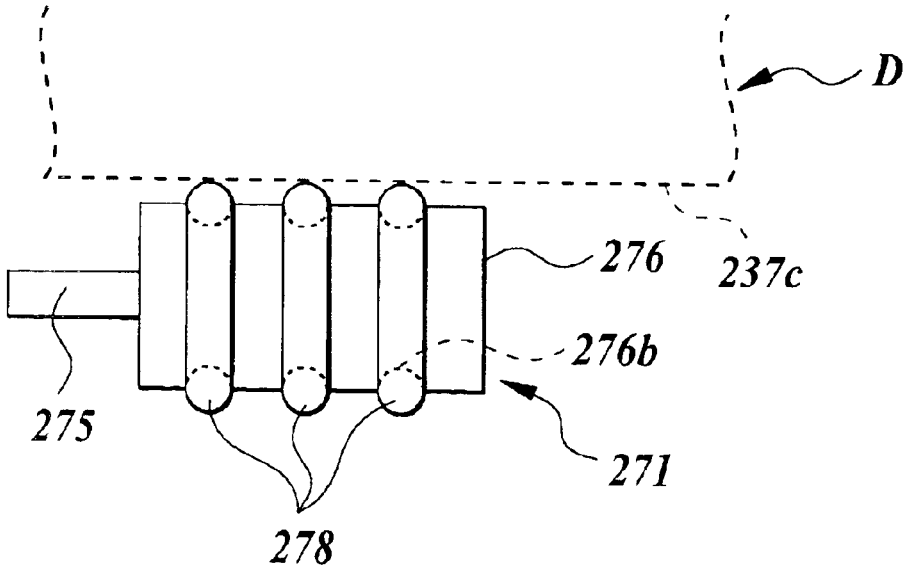
FIG. 27 is a side view showing a modified example of the rotation component 271 shown in FIG. 26.

Further, the rotation component 271 of the position regulation component 270 shown in FIGS. 25 and 26, may have another structure. For example, as shown in FIG. 27, the rotation component 271 may comprise an O-ring 278 as the resilient component, the O-ring 278 fitted in a plurality of grooves 276*b* formed at the outer periphery of the cylindrically shaped basic body 276 of the rotation component 271. The plurality of O-rings 278 are in contact with the smooth layer 237*c* (shown in a dotted line in FIG. 27) which is the outermost layer of the heating drum D.

Because of the structure shown in FIG. 27, as well as FIG. 26, a friction coefficient between the plurality of O-rings 278 and the smooth layer 273*c* becomes higher. As a result, since the rotation component 271 can surely be rotated with following the rotation of the heating drum D, damage such as a scratch, a peeling or the like on the smooth layer 237*c* of the heating drum D can be prevented. That is, deterioration of the heating drum D from the damage on the smooth layer 237*c* can be prevented. Preferably, the O-ring 278 is made of rubber material such as silicon rubber or the like.

Here, if there is concern about durability of the above-mentioned O-ring 278, it is sufficient to exchange the O-ring 278 upon periodic maintenance of the apparatus as a periodic exchange part. Further, it is easy to exchange the O-ring without particular tools. Here, the rotation component 271 may be made of metal and coated with silicon rubber for forming high friction coefficient surface. In this case also, preferably, the rotation component 271 is treated as a periodic exchange part upon periodic maintenance of the apparatus.

According to the thermal development apparatus or the thermal development method in the third embodiment of the present invention, when the heating drum D which rotates for conveying and heating the thermal development photosensitive film F as thermal development photosensitive material, comprises the smooth layer 237*c* made of fluorine resin or the like on its surface, the rotation component 271 which regulates a position of the guide component 248 against the heating drum D, can surely be rotated with following the rotation of the heating drum D. As a result, damage on the smooth layer 237*c* can be prevented and deterioration on the heating drum D can be prevented.

The entire disclosure of Japanese Patent Applications Nos. Tokugan 2002-208438 filed on Jul. 17, 2002, Tokugan 2002-373841 filed on Dec. 25, 2002 and Tokugan 2002-373843 filed on Dec. 25, 2002 including specifications, claims, drawings and summaries are incorporated herein by reference in their entirety.

What is claimed is:

1. A thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the smooth layer being configured to prevent a gaseous component from permeating to the resilient member from the thermal development photosensitive material.

2. The apparatus of claim 1, wherein thickness of the smooth layer is equal to or more than 3 $\mu$m.

3. The apparatus of claim 1, further comprising a biasing component for biasing the thermal development photosensitive material against the heating section.

4. The apparatus of claim 1, wherein the smooth layer has predetermined resistance to chemical reaction.

5. The apparatus of claim 1, wherein the smooth layer is made of a component including fluorine.

6. The apparatus of claim 5, further comprising a temperature detecting section for detecting surface temperature of the smooth layer by being in contact with the smooth layer.

7. The apparatus of claim 1, further comprising a cleaning section for cleaning the smooth layer.

8. Thermal development photosensitive material adoptable for the thermal development apparatus of claim 1, comprising a particle for providing predetermined frictional resistance in a contact surface thereof with the smooth layer.

9. The photosensitive material of claim 8, wherein a particle diameter of the particle is 0.5 μm to 10 μm.

10. The photosensitive material of claim 8, further comprising the same substance as one of which the smooth layer is made.

11. The apparatus of claim 1, further comprising:

a driving section for driving the heating section to rotate; and a control section for controlling the heating section so as to rotate the heating section at lower speed when the thermal development photosensitive material is not conveyed than when the thermal development photosensitive material is conveyed.

12. The apparatus of claim 11, further comprising;

a plurality of opposed rollers placed so as to be opposed to the heating section; and a biasing section for biasing the plurality of opposed rollers against the heating section, wherein the conveyance section conveys the thermal development photosensitive material nipped between the heating section and the opposed roller by the biasing section while the heating section is driven to rotate by the driving section.

13. The apparatus of claim 12, wherein each of the plurality of opposed rollers is made of metal and grounded.

14. The apparatus of claim 11, further comprising an electro static charge removal member for discharging electro static charge of the heating section.

15. The apparatus of claim 12, wherein a first gear is provided at at least one end of the heating section, and a second gear which engages with the first gear, is provided at at least one end of at least one opposed roller of the plurality of opposed rollers, and the at least one opposed roller is driven to rotate by the first gear and the second gear.

16. The apparatus of claim 11, wherein the smooth layer is made of fluorine resin.

17. The apparatus of claim 11, wherein the control section controls the heating section to rotate the heating section at lower speed for a warm-up period of the apparatus than when the thermal development photosensitive material is conveyed.

18. A thermal development method comprising:

heating and conveying thermal development photosensitive material between a heating section which comprises a smooth layer and which is driven to rotate, and the plurality of opposed rollers biased against the heating section; and driving the heating section to rotate at lower speed when the thermal development photosensitive material is not conveyed than when the thermal development photosensitive material is conveyed.

19. The method of claim 18, wherein the smooth layer is made of fluorine resin.

20. The apparatus of claim 1, further comprising:

a cooling conveyance section for cooling and conveying the thermal development photosensitive material; and a guide component for guiding the thermal development photosensitive material from the heating section to the cooling conveyance section, wherein the guide component comprises a pair of rotation components capable of rotating with following a rotation of the heating section, as opposed to both ends of a rotation axis of the heating section for maintaining relative positions to the heating section; and each of the rotation components comprises a component with a high friction coefficient against the smooth layer of the heating section.

21. The apparatus of claim 20, wherein each of the rotation components comprises a resilient component as the component with the high friction coefficient.

22. The apparatus of claim 20, wherein the smooth layer is made of fluorine resin.

23. The apparatus of claim 21, wherein the resilient component includes a rubber layer provided at a periphery of each of the rotation components.

24. The apparatus of claim 21, wherein the resilient component includes a ring-shaped component provided at a periphery of the rotation component.

25. The apparatus of claim 21, wherein a groove in which the resilient component is fitted is formed at a periphery of each of the rotation components.

26. The apparatus of claim 21, wherein the resilient component of each of the rotation components is made of the same substance as the resilient member of the heating section.

27. A thermal development apparatus comprising:

a heating section for heating and conveying thermal development photosensitive material within which a latent image is established, and maintaining the thermal development photosensitive material at thermal development temperature; and a cooling section for cooling and conveying the heated thermal development photosensitive material;

wherein the heating section comprises a heating member, a resilient member outside of the heating member, and a smooth layer at uppermost surface of the resilient member, the smooth layer being configured to prevent a gaseous component from permeating to the resilient member from the thermal development photosensitive material.

28. The apparatus of claim 27, wherein thickness of the smooth layer is equal to or more than 30 μm.

29. The apparatus of claim 27, wherein the smooth layer has predetermined resistance to chemical reaction.

30. The apparatus of claim 27, wherein the smooth layer is made of a component including fluorine.

31. Thermal development photosensitive material adoptable for the thermal development apparatus of claim 27, comprising a particle for providing predetermined frictional resistance in a contact surface thereof with the smooth layer.

32. The photosensitive material of claim 31, wherein a particle diameter of the particle is 0.5 μm to 10 μm.

33. The photosensitive material of claim 31, further comprising the same substance as one of which the smooth layer is made.

34. The apparatus of claim 27, wherein the apparatus conveys various size of the photothermographic element, which is formed in a square shape and which is any width in a perpendicular direction to a conveying direction of the heating section.

35. A thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the smooth layer being made of a component including fluorine, the apparatus further comprising a temperature detecting section for detecting surface temperature of the smooth layer by being in contact with the smooth layer.

36. A thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the apparatus further comprising a cleaning section for cleaning the smooth layer.

37. Thermal development photosensitive material adoptable for a thermal development apparatus, the thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the thermal development photosensitive material comprising a particle for providing predetermined frictional resistance in a contact surface thereof with the smooth layer.

38. The photosensitive material of claim 37, wherein a particle diameter of the particle is 0.5 $\mu$m to 10 $\mu$m.

39. The photosensitive material of claim 37, further comprising the same substance as one of which the smooth layer is made.

40. A thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the apparatus further comprising:

a driving section for driving the heating section to rotate; and a control section for controlling the heating section so as to rotate the heating section at lower speed when the thermal development photosensitive material is not conveyed than when the thermal development photosensitive material is conveyed.

41. The apparatus of claim 40, further comprising:

a plurality of opposed rollers placed so as to be opposed to the heating section; and a biasing section for biasing the plurality of opposed rollers against the heating section, wherein the conveyance section conveys the thermal development photosensitive material nipped between the heating section and the opposed roller by the biasing section while the heating section is driven to rotate by the driving section.

42. The apparatus of claim 41, wherein each of the plurality of opposed rollers is made of metal and grounded.

43. The apparatus of claim 40, further comprising an electro static charge removal member for discharging electro static charge of the heating section.

44. The apparatus of claim 41, wherein a first gear is provided at at least one end of the heating section, and a second gear which engages with the first gear, is provided at at least one end of at least one opposed roller of the plurality of opposed rollers, and the at least one opposed roller is driven to rotate by the first gear and the second gear.

45. The apparatus of claim 40, wherein the smooth layer is made of fluorine resin.

46. The apparatus of claim 40, wherein the control section controls the heating section to rotate the heating section at lower speed for a warm-up period of the apparatus than when the thermal development photosensitive material is conveyed.

47. A thermal development apparatus comprising:

a heating section for heating thermal development photosensitive material within which a latent image is established, and maintaining the thermal development photosensitive material at thermal development temperature; and a conveyance section for conveying the thermal development photosensitive material using the heating section;

wherein the heating section comprises a cylindrical sleeve, a heating source provided inside of the cylindrical sleeve, and a resilient member on an external surface of the cylindrical sleeve, and the resilient member comprises a smooth layer on its outermost surface, the apparatus further comprising:

a cooling conveyance section for cooling and conveying the thermal development photosensitive material; and a guide component for guiding the thermal development photosensitive material from the heating section to the cooling conveyance section, wherein the guide component comprises a pair of rotation components capable of rotating with following a rotation of the heating section, as opposed to both ends of a rotation axis of the heating section for maintaining relative positions to the heating section; and each of the rotation components comprises a component with a high friction coefficient against the smooth layer of the heating section.

48. The apparatus of claim 47, wherein each of the rotation components comprises a resilient component as the component with the high friction coefficient.

49. The apparatus of claim 47, wherein the smooth layer is made of fluorine resin.

50. The apparatus of claim 48, wherein the resilient component includes a rubber layer provided at a periphery of each of the rotation components.

51. The apparatus of claim 48, wherein the resilient component includes a ring-shaped component provided at a periphery of the rotation component.

52. The apparatus of claim 48, wherein a groove in which the resilient component is fitted is formed at a periphery of each of the rotation components.

53. The apparatus of claim 48, wherein the resilient component of each of the rotation components is made of the same substance as the resilient member of the heating section.

54. Thermal development photosensitive material adoptable for a thermal development apparatus, the thermal development apparatus comprising:

a heating section for heating and conveying thermal development photosensitive material within which a latent image is established, and maintaining the thermal development photosensitive material at thermal development temperature; and a cooling section for cooling and conveying the heated thermal development photosensitive material;

wherein the heating section comprises a heating member, a resilient member outside of the heating member, and a smooth layer at uppermost surface of the resilient member, the thermal development photosensitive material comprising a particle for providing predetermined frictional resistance in a contact surface thereof with the smooth layer.

55. The photosensitive material of claim 54, wherein a particle diameter of the particle is 0.5 $\mu$m to 10 $\mu$m.

56. The photosensitive material of claim 54, further comprising the same substance as one of which the smooth layer is made.

* * * * *